US010199016B2

(12) United States Patent
Hellinge

(10) Patent No.: US 10,199,016 B2
(45) Date of Patent: Feb. 5, 2019

(54) ELEMENTS TO IMPROVE THE SOUND QUALITY OF STRINGED MUSICAL INSTRUMENTS

(76) Inventor: Andreas Hellinge, Satigny (CH)

( * ) Notice: Subject to any disclaimer, the term of this patent is extended or adjusted under 35 U.S.C. 154(b) by 0 days.

(21) Appl. No.: 13/997,859

(22) PCT Filed: Dec. 23, 2011

(86) PCT No.: PCT/IB2011/055944

§ 371 (c)(1),
(2), (4) Date: Aug. 30, 2013

(87) PCT Pub. No.: WO2012/090145

PCT Pub. Date: Jul. 5, 2012

(65) Prior Publication Data

US 2014/0144305 A1 May 29, 2014

(30) Foreign Application Priority Data

Dec. 28, 2010 (EP) ..... 10197182

(51) Int. Cl.
*G10D 3/00* (2006.01)
*G10D 3/06* (2006.01)
*G10D 3/12* (2006.01)

(52) U.S. Cl.
CPC ..... *G10D 3/00* (2013.01); *G10D 3/06* (2013.01); *G10D 3/12* (2013.01)

(58) Field of Classification Search
CPC ..... G10D 1/08; G10D 1/085; G10D 3/02; G10D 3/06; G10D 1/00; G10D 1/005; G10D 1/10; G10D 3/14; G10D 3/00; G10D 3/143; G10D 3/146; G10D 3/18; G10D 1/02; G10D 3/12; G10G 7/00
USPC ..... 84/267, 290, 293
See application file for complete search history.

(56) References Cited

U.S. PATENT DOCUMENTS 2,225,613 A * 12/1940 Alyn ..... 84/314 R
4,951,542 A * 8/1990 Chen ..... G10D 3/06 84/293
4,969,381 A * 11/1990 Decker, Jr. ..... G10D 1/005 84/193

(Continued)

FOREIGN PATENT DOCUMENTS

GB 397 760 A 8/1933
JP H02-73295 3/1990

(Continued)

OTHER PUBLICATIONS

International Preliminary Report on Patentability for International (PCT) Patent Application No. PCT/IB2011/055944 dated Jul. 2, 2013, 6 pages.

(Continued)

*Primary Examiner* — Kimberly Lockett
(74) *Attorney, Agent, or Firm* — Sheridan Ross P.C.

(57) ABSTRACT

The present invention concerns modifications intended to improve the sound quality of stringed musical-instruments through modification of stiffness/flexibility, vibration/resonance-transmitting properties and weight-reduction of the fingerboard, neck, tailpiece, the upper- and lower block, sound post or sound pegs, bass bar or sound bars, and the upper and lower saddle rod using combined lightweight materials and specific construction principles.

25 Claims, 16 Drawing Sheets

(56) References Cited

U.S. PATENT DOCUMENTS

| | | | | |
|---|---|---|---|---|
| 5,072,643 | A | 12/1991 | Murata | |
| 5,955,688 | A | 9/1999 | Cook | |
| 6,100,458 | A * | 8/2000 | Carrington | G10D 1/005 84/267 |
| 6,737,568 | B2 * | 5/2004 | Schleske | G10C 3/06 84/290 |
| 7,112,733 | B1 * | 9/2006 | Babicz | 84/298 |
| 2003/0106409 | A1 * | 6/2003 | McPherson | 84/293 |
| 2008/0190264 | A1 * | 8/2008 | Jones | G10D 3/06 84/314 R |
| 2012/0192698 | A1 * | 8/2012 | Allred, III | G10D 3/06 84/293 |

FOREIGN PATENT DOCUMENTS

| | | |
|---|---|---|
| JP | H04-44696 | 4/1992 |
| JP | 2001-117558 | 4/2001 |
| JP | 2010-0044112 | 2/2010 |

OTHER PUBLICATIONS

International Search Report prepared by the European Patent Office dated Apr. 18, 2012, for International Application No. PCT/IB2011/055944.

Official Action (with English translation) for Japanese Patent Application No. 2013-546804, dated Jul. 21, 2015, 11 pages.

Official Action (with English translation) for Chinese Patent Application No. 201180063287.7, dated Sep. 1, 2015, 14 pages.

* cited by examiner

ELEMENTS TO IMPROVE THE SOUND QUALITY OF STRINGED MUSICAL INSTRUMENTS

CROSS REFERENCE TO RELATED APPLICATIONS

This application is a national stage application under 35 U.S.C. 371 and claims the benefit of PCT Application No. PCT/IB2011/055944 having an international filing date of 23 Dec. 2011, which designated the United States, and which PCT application claimed the benefit of European Patent Application No. 10197182.8 filed 28 Dec. 2010, the disclosure of which is incorporated herein by reference.

FIELD OF THE INVENTION

The present invention concerns modifications intended to improve the sound quality of stringed musical-instruments through modification of stiffness/flexibility, vibration/resonance-transmitting properties and weight-reduction of the fingerboard, neck, neck heel, peg-box, scroll, the upper and lower saddle, the upper- and lower block, the tailpiece, the tailpiece-gut, the lower peg, the sound-post or sound pegs, the bass bar or sound bars using combined lightweight materials and construction principles.

More specifically, the present inventions relate to the improvements of the acoustical qualities of stringed musical-instruments, either bowed (violin-family and viola da gamba-family) or plucked (guitar and luth-family), and instruments of the Guzheng family from China, or the Indian Sarangi-, Esraj-, and Dilruba Family Each of these inventions can be used by itself as a standalone product, but also be combined with the other inventions listed here.

The sound of the instruments will improve if:

1. the string-vibration is of a pure and dense quality, obtained by a strong holding position for the strings (stiffness/flexibility of fingerboard/upper saddle, neck, upper and lower block)
2. the string-vibration is well transmitted to the resonance body of the instrument, not only directly by the bridge, but also through upper saddle, fingerboard, neck and upper block, as well as by the tailpiece, tail-gut, lower saddle, lower peg and lower block
3. the string-vibration is less damped by low specific weight of these instrument parts.

These modifications are made by using new materials, today rarely or not used in the field of producing traditional string instruments. The techniques to apply these new materials or material-combinations are known in other totally different areas like the construction of airplanes, boats, pipelines and others, but have never been used before in this manner for musical instrument parts as described below.

PRIOR ART/BACKGROUND OF THE INVENTION

The basic construction-parts of stringed musical-instruments, acoustic or electrical, are: (as illustrated in FIG. 1(*a*) for a violin and FIG. 1(*b*) for a guitar):

1) Strings (FIGS. 3 and 4)
2) Neck
3) Fingerboard
4) Pegs
5) Tailpiece
6) Tailgut

7) Peg, lower
8) Bridge
9) Body (FIGS. 3 and 4)
10) Saddle, upper
11) Block, upper and lower
12)
13) Saddle, lower
14) Corner block
15) Ribs
16) Sound post
17) Corner
18) Linings
19) Resonance-Table
20) Peg box
21) Peg holes
22) Scroll
23) Neck heel
24) Back of instrument The Strings 1

The strings 1 are the elements that are generating the vibrations of a stringed musical instrument, plucked or bowed, acoustically or electrically amplified. They run parallel to the fingerboard 3 which is attached to the neck, or an integral part of it.

The strings were traditionally made out of animal intestines (gut) or wound metal on a gut core; today we call these strings gut strings. Modern strings have either gut, synthetic or metallic cores, wound with various metals, or alloys. These strings may be wound in several layers, and contain special softer material layers, in order to control the damping of vibrations.

The Neck 2

In order to support string-tension and to allow an efficient string-vibration when plucked or bowed, the stringed musical-instruments need a strong holding position for their strings. Much of this tension is supported by the neck 2. The neck comprises:

A Neck 2, a neck-heel 23, a peg-box 20, and a scroll 22 (scroll is only a part of the neck in the violin-family, viola- and da gamba-family)

All of the stringed musical instruments need a neck 2 being, as little as possible: prone to distortion through string-tension or other tensions created by playing the instrument. As the neck 2 transmits a part of the vibrations generated by the strings 1 to the resonance body of the instrument, flexibility to some degree is required. Therefore, the architecture of this neck 2, the materials used for its construction, and its assembly-quality to the resonance body, are essential for the instrument's global resonance efficiency.

The traditional neck 2 is made out of wood, usually hardwood, in order to resist string tension. Other materials which have been used in more recent times to increase the strength of the neck is glass-fiber, plied wood, reinforced plastic and carbon-fiber, mostly for the construction of instruments in the guitar-family. These materials may also be found in the construction of violin-family instrument necks 2, in case that the instrument is more or less entirely constructed by using these materials.

The peg box 21 at the opposite of the neck heel 23 is made out of the same wood as the neck 2. It provides essential room for the pegs 4. Some stringed instruments wear a decorative element at the end of the peg box 20. Examples of decoration are:

carved representations of animal or human heads
a spiral volute 22

The necks of the plucked musical instruments are usually constructed in a different way than those of bowed musical instruments:

Plucked Instruments:

neck 2 and neck-heel 23 are often made of two wooden parts glued together the neck 2 is proportionally long compared to bowed instrument's necks the neck 2 is also wide enough to allow space for at least 6 strings because of its larger dimensions, plucked instrument's necks 2 are usually heavier than those of bowed instruments.

Bowed Instruments:

neck 2 and neck-heel 23 are usually made out of one piece of wood the neck 2 is proportionally short compared to plucked instrument's necks the neck 2 of violin family instruments is comparatively narrow, it only needs to allow space for 4 strings (cello and double-bass in some cases 5 strings)

Fingerboard 3

The wooden neck 2 alone is not strong enough to support the tension of the strings 1 without major distortion, because its dimensions are limited due to playing comfort. It is relying for increased strength on its lamination with the fingerboard 3; especially on bowed musical-instruments.

Ebony or other hardwoods are considered the preferred material for modern fingerboards 3 because of these wood's solidity, beauty, touch-qualities and superior resistance to wear. Most of the plucked string instruments are carrying a veneer (Veener in this context is solid wood of a thickness of about 1 to 10 mm), or solid piece of ebony or hardwood as a fingerboard 3; these fingerboards 3 usually have inserts of so called fret bands.

Pegs 4

At the neck end, the strings ride over the upper saddle 10 into the peg box 20, where they wound around the pegs 4 to provide tension. Today the strings 1 usually have a colored wrapping at both ends, for identification and to provide friction when inserted into the pegs 4. The peg shafts are shaved to a standard taper, their corresponding peg box holes 21 being reamed to the same taper, allowing the friction to be increased or decreased by the player applying appropriate pressure along the axis of the peg 4 while turning it. Pegs 4 are mostly made of wood or machine tuners in various metals will be found on double basses and the major part of plucked instruments.

Tailpiece 5

The opposite ends of the strings are fixed to the tailpiece 5 (bowed musical instruments), which itself is loosely attached to the body by the tail-gut 6 and lower peg 7'. On plucked instruments the tailpiece 5 is part of the bridge and glued on the instrument's resonance table 19.

The tailpiece 5 may be made of wood, metal, or plastic. It must be strong enough to support the tension of the strings 1.

Tail-Gut 6

The tail-gut 6 attaches the tailpiece 5 to the lower peg and transmits the vibrations of the strings via the tailpiece, the lower saddle and lower peg to the instrument's resonance body.

Lower Peg 7

The lower peg 7 is the only peg which is inserted directly into the body of the instrument (the lower peg is only a part of the violin-family). Its vibration/resonance-transmitting qualities are important. The lower peg is shaped to a conical or cylindrical tapper, and extends into the lower block.

Bridge 8

The bridge 8 forms the lower anchor point of the vibrating length of the strings, and transmits the vibrations of the strings directly to the resonance-table 19 of the instrument. This bridge's upper part holds the strings at a proper distance from the fingerboard 3. The distribution of string angle and flex of the bridge 8, acting as a mechanical acoustic filter, has a prominent effect on the sound of bowed instruments. These have their bridge 8 only held in place by string tension, whereas plucked instruments have their bridge 8 glued on the resonance-table 19 of the instrument, and the tailpiece 5 is in this case part of the bridge 8.

The Body 9

The three-dimensional instrument-body 9 consists of table 19, back 24 and rib-structure 15. Its architecture is elaborated to allow an efficient resonance capacity. In case of an electrical or semi-electrical instrument, the string-vibrations are entirely or partly enhanced by electromagnetic sensors or microphones. The body 9 can be made completely out of wood, metal, plastic, and carbon-fiber or by using a combination of these materials with in some cases the top made of hide or other membranes.

Inside the body, different supporting elements such as corner blocks 14, upper- and lower block 11, 11' and linings 18 are inserted. These are traditionally made out of the same material as the main parts of the body, but beech, willow and poplar are also frequently used. Structural elements such as sound-bares (bass bares 25) or soundpegs (sound post 16) are fitted inside this body, in order to enhance resistance to string tension as well as resonance-abilities of the stringed instrument. These interior fittings are mostly made of spruce.

Upper Saddle 10, Lower Saddle 13

Traditionally settled as a separated piece at the peg box 20 end of the fingerboard 3, the upper saddle 10 comprises grooves to position the strings as they lead towards the bridge 8, and its upper part holds the strings 1 at a proper but low distance from the fingerboard 3. The upper saddle 10 has a direct contact to fingerboard 3 and neck 2 and its string-vibration transmitting ability is an important one. On bowed instruments the lower saddle 13 grooves to position the tailpiece-gut 6, and it is directly glued to the resonance-body of the instrument, and its vibration transmitting ability is also an important one. The commonly used materials for its construction are hardwoods such as ebony, or ivory.

Upper- and Lower Blocks, Corner Blocks 11, 11', 14

The upper 11-lower 11' and corner 14 blocks are traditionally made out of wood: spruce, willow and poplar are frequently used. Today the neck 2 is attached to the resonance body by inserting the neck-heel 23 into the upper block 11. The form, construction, dimensions, density and position of the upper block 11 is therefore essential for the stiffness/flexibility of the structure fingerboard 3/neck 2 and thus for the quality of the resonance generated by the stringed instrument, especially in the context of this invention. On bowed instruments, the lower block 11' is supporting the string-tension on the opposite side of the instrument's resonance-body, and the corner blocks 14 are in charge to hold the rib-corners 17 together. The lower block 11' also participates in the resonance transmitting of the lower peg 7.

The prior art also includes the following publications: FR 2 807 862, FR 2 762 706, U.S. Pat. No. 4,809,579, GB 397 760, TW 305411Y, JP 2005326703.

DETAILED DESCRIPTION OF THE INVENTION

An aim of the present invention is to improve the known instruments.

More specifically, an aim of the present invention is to provide new elements for stringed instruments that bring notable improvements to the sound and playability of said stringed instruments.

The present invention will be better understood from the following detailed description and from the drawings which show:

The plucked and bowed stringed instruments have gone through changes which have improved the playability of the instrument in order to execute more demanding musical scores, as well as to make the stringed instruments sound stronger by elongating the vibrating string length. At the same time these changes influenced the way tensions are distributed within the instrument, sometimes in an unfavorable way.

Figure 1A:
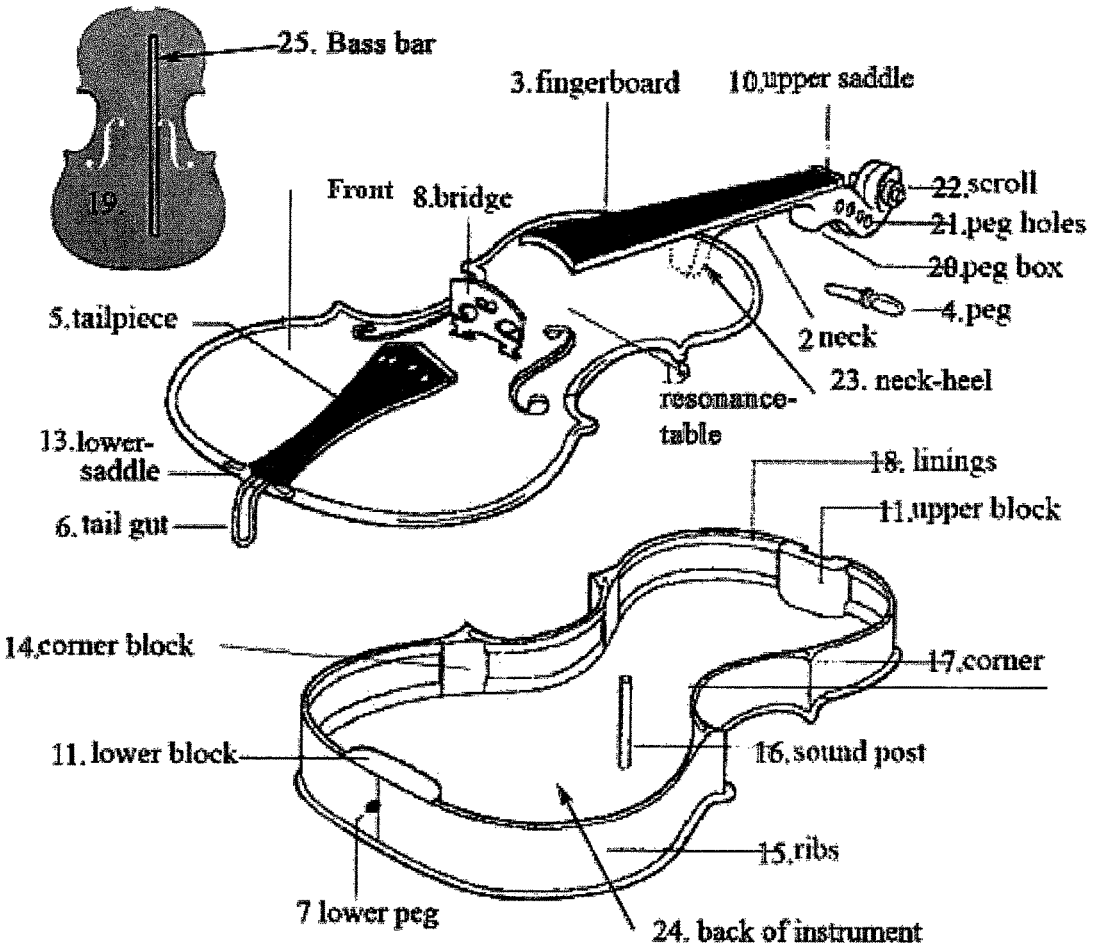
FIG. 1 illustrates the different parts forming a stringed instrument such as a violin (FIG. 1(*a*)) and guitar (FIG. 1(*b*))
Figure 1B:
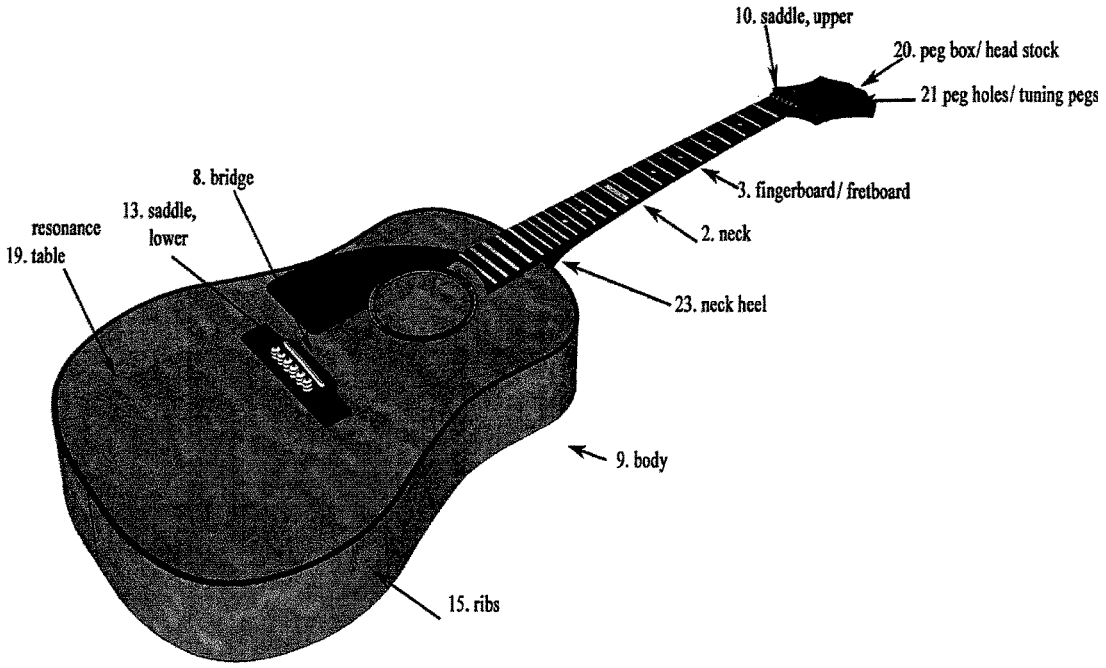
Figure 2:
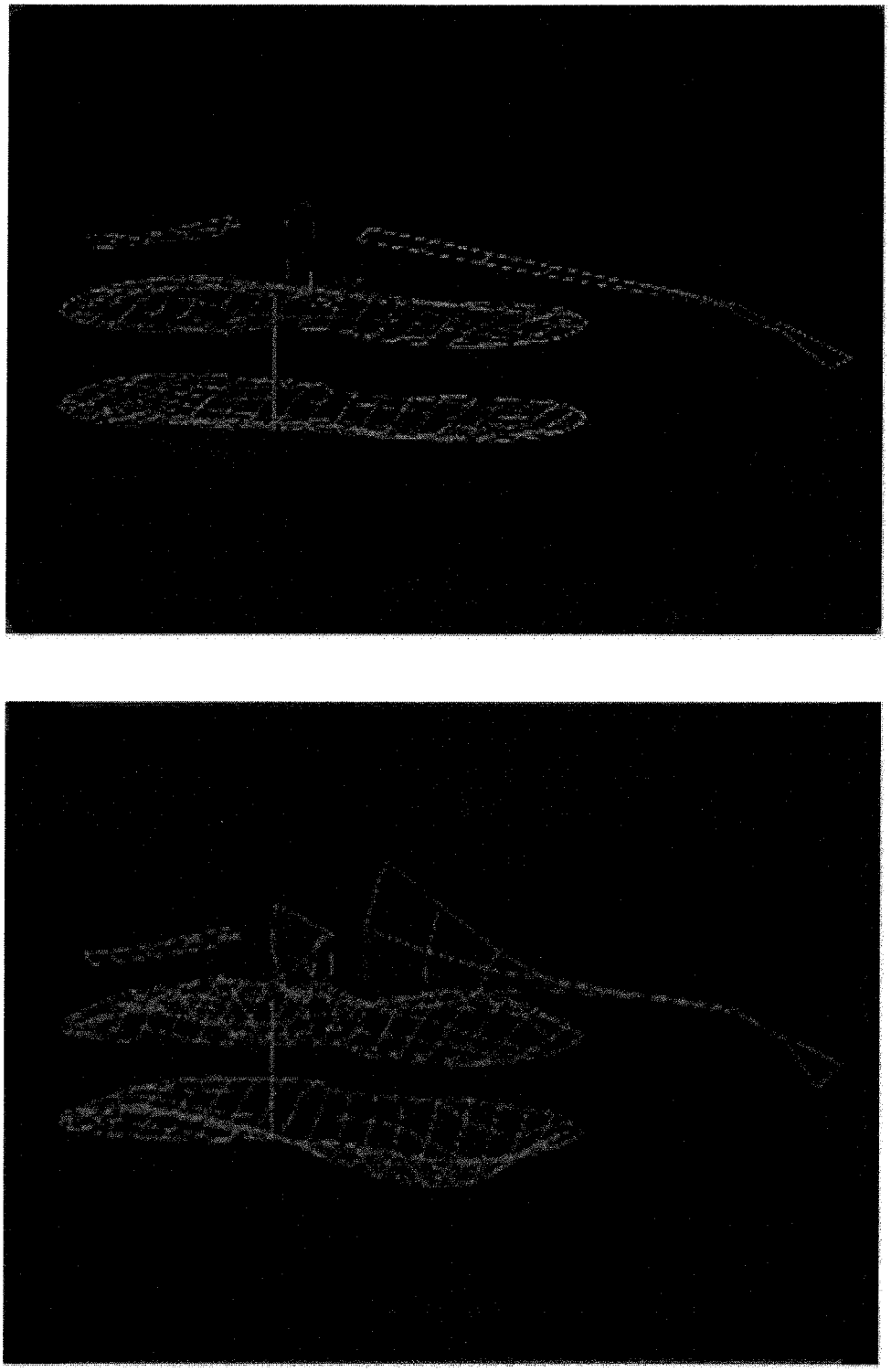
FIG. 2 illustrates the resonance effect on a violin (upper drawing in rest, lower drawing with moving strings: the amplitude is strongly exaggerated picture of the vibration taking place in the instrument.
Figure 3:
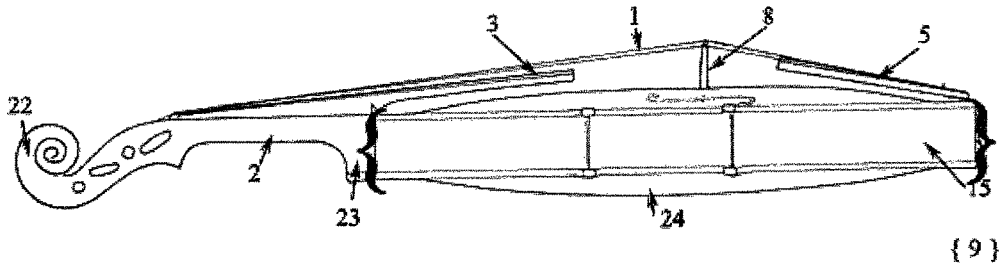
FIGS. 3 and 4 illustrate the neck and fingerboard of a violin before 1800 and after 1800.
Figure 4:
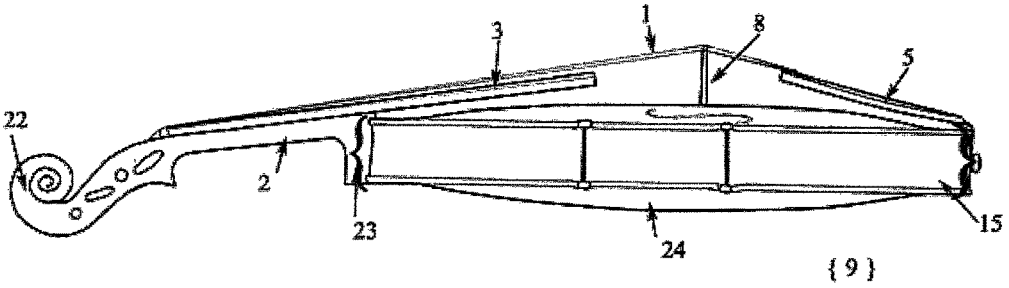

For example the bowed instruments of the violin family (violin, viola, tenor-viola, cello, and double bass) have gone through the following historical changes:

Changes to the Neck 2 (See FIGS. 3 and 4 Showing a Violin as in FIG. 1(*a*))

The necks of the instruments being part of the violin family was originally (1st. half of the 16th. century until the end of the 18th. century) shorter than today. In order to allow an altered fingerboard and to achieve better playability in higher positions, these necks were altered in different ways. These changes took place towards the turn of the 18th. century. (1800).

1) in case of the violin, the neck 2 was prolonged about 6 to 10 mm, in order to achieve a new standard neck length of about 130 mm between the upper saddle 10 and the neck insertion into the violin's body 9, measured at the edge of its resonance-table. The now longer string-length, the rising of the pitch (the note A) from historically ca 415 Hz to today's over 440 Hz, the evolution in string-production to heavier and thus higher tensioned strings 1, made especially the neck heel 23 and upper block 11 of musical instrument's resonance-bodies 9 (also plucked musical instruments) more prone to get distorted due to the resulting substantially higher tension
2) The weak spot, the heel 23 of the neck, was further weakened when the heel 23 had to be reduced in size and substance to improve the playability of the instruments in higher positions.
3) The thickness of the neck 2 was also reduced for sake of playing comfort.
4) Finally, the neck angle insertion into the resonance-body 9 was altered (compare FIGS. 3 and 4), in order to allow a different shape of the fingerboard (now uniform parallel edges from its top to bottom). The neck heel 23 was furthermore inserted in a new way, the neck 2 being raised about 5 mm (violin) above the table edge. This weakened the neck-heel 23 furthermore and substantially.

Figure 5:
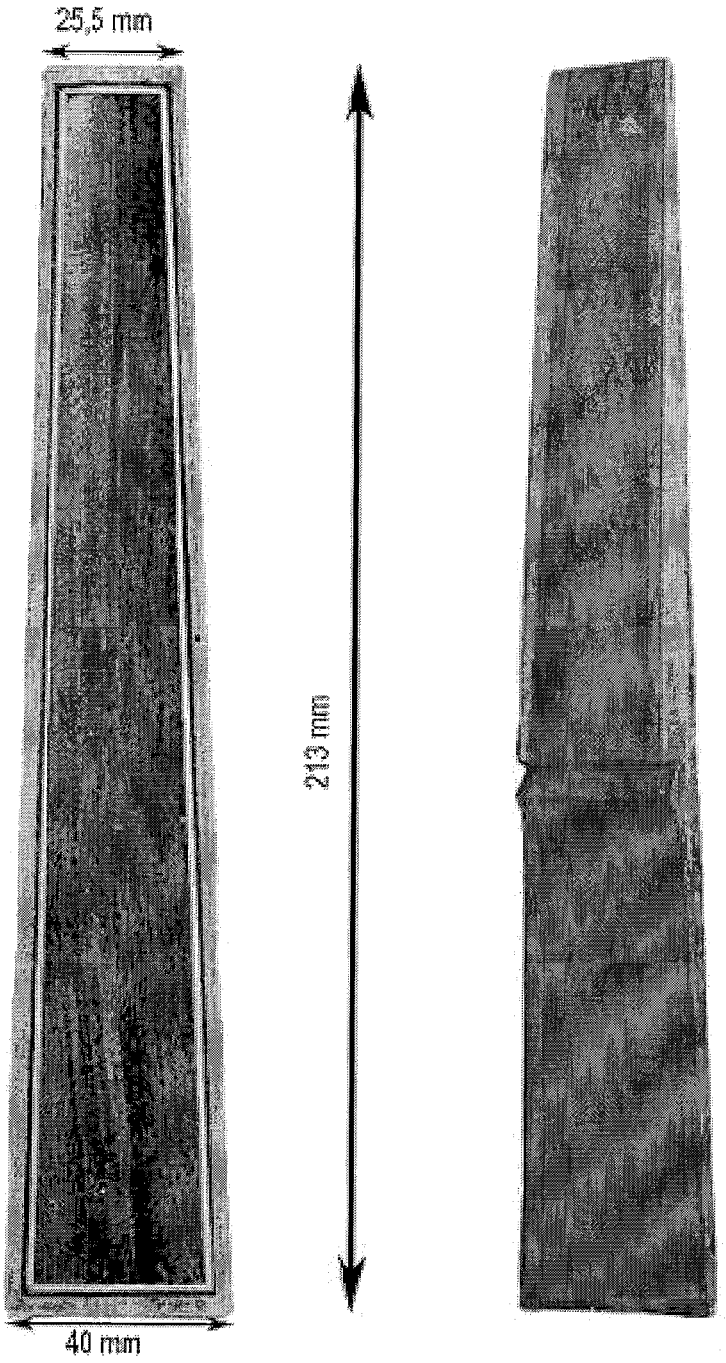
FIGS. 5 and 6 illustrate the size of a fingerboard before 1800 and after 1800.
Figure 6:
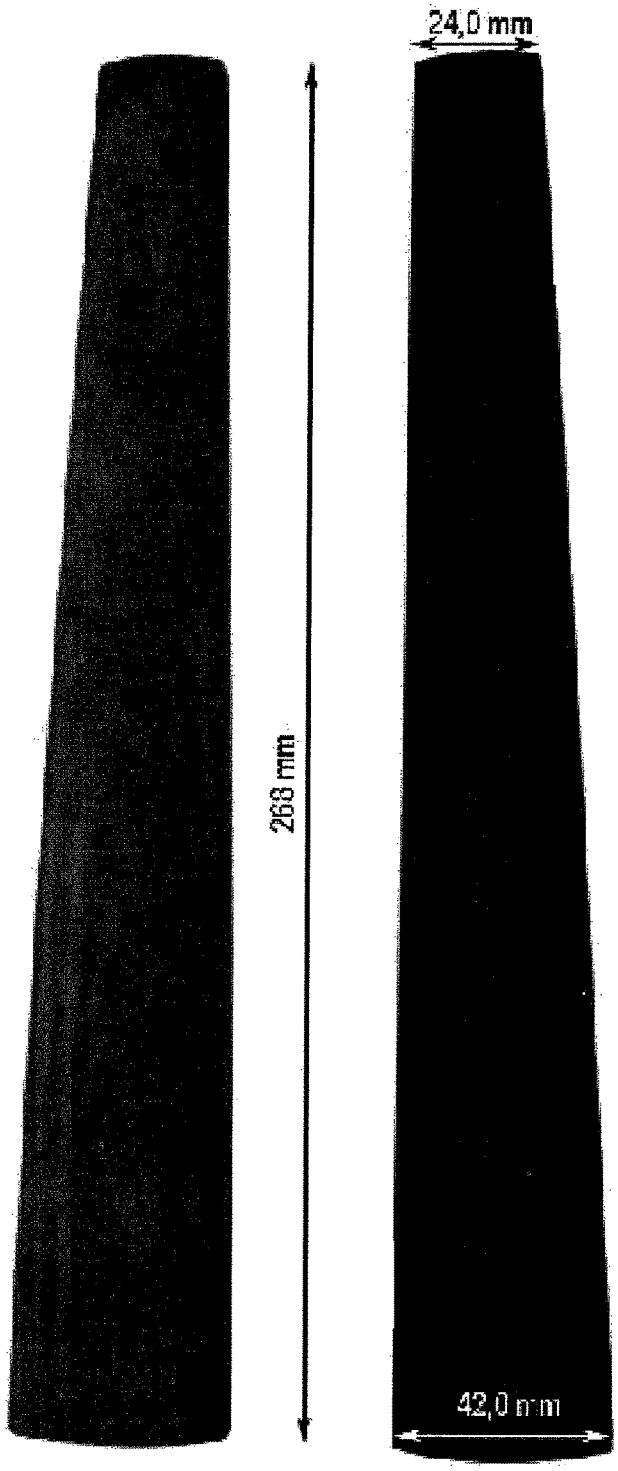
Figure 7:
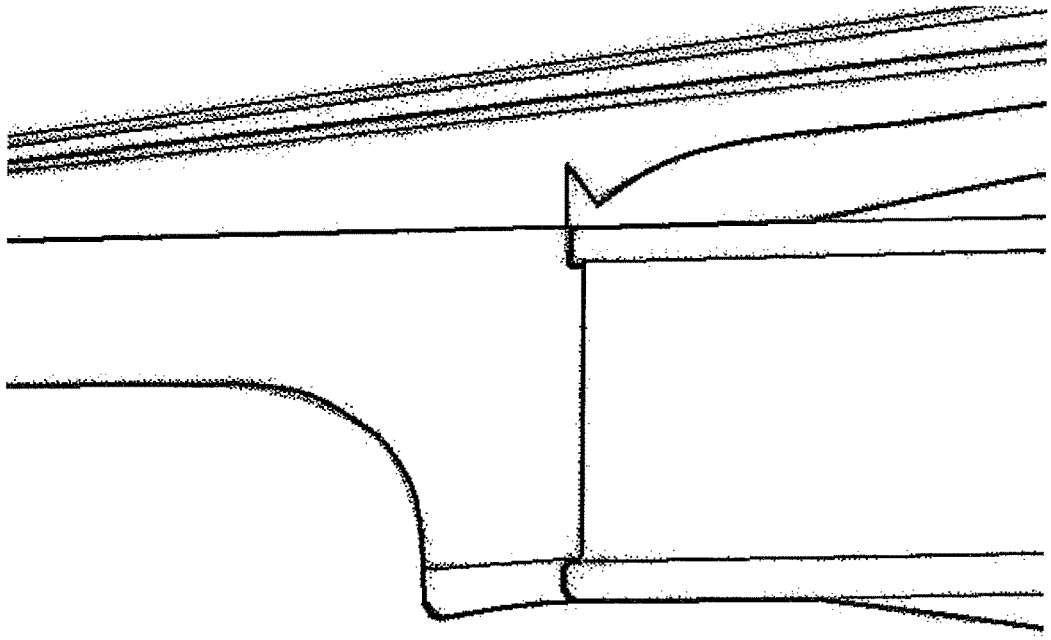
FIGS. 7 and 8 illustrate the heel of the neck of a violin before 1800 and after 1800.
Figure 8:
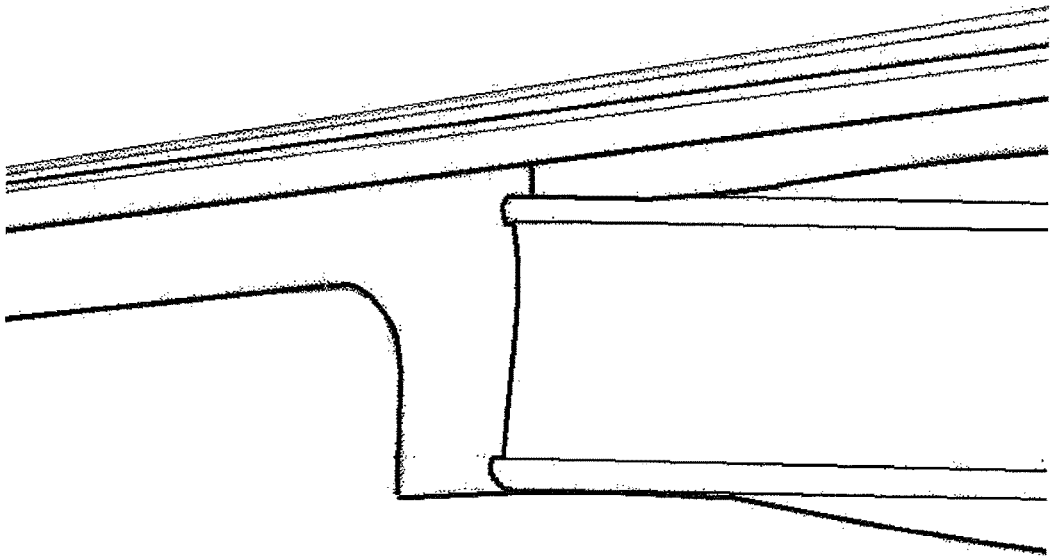
Figure 9:
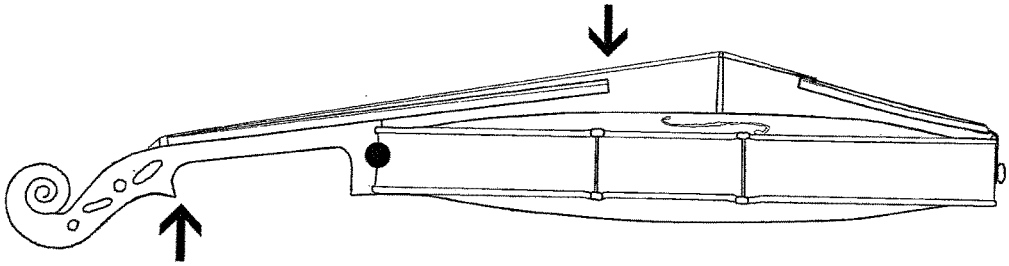
FIG. 9 illustrate the pivot area on the fingerboard-neck combination.

Changes to the Fingerboard 3 (See FIGS. 5 and 6)

The historical fingerboard 3 was made of light wood, mostly poplar, willow or spruce, laminated by applying one thin coat of hardwood veneer. This composite fingerboard structure was developed to keep down the fingerboard's weight. This fingerboard 3 also had a different shape and other dimensions than the modern one. (compare FIGS. 3, 4, 5 and 6)) The main changes which occurred to the fingerboard around 1800 were:

1. Due to the changed length of the neck 2, the fingerboard 3 had to be made longer. The length now also extended further over the body 9, closer to the bridge 8, in order to allow the production of higher tones.
2. Instead of using a laminated type of fingerboard, the new fingerboard 3 was now made of one single piece of hardwood; ebony was preferred. The stiffness and weight of the fingerboard 3 increased.
3. The original wedged profiled fingerboard, with its thinnest section close to the upper saddle 10, and its thickest section above the neck heel 23, was replaced by a fingerboard 3 with uniform parallel edges from its top to bottom. This occurred to the fingerboard/neck structure a more homogeneous flexibility in its longitudinal distribution compared to the more detailed flexibility which can be found in the historical structure fingerboard/neck.

Lack of Evolutionary Changes to the Upper- and Lower Blocks 11, 11'

The upper block 11 supports the neck heel 23, and transmits the vibrations created by the strings from the upper-saddle/fingerboard/neck structure to the resonance body of the instrument. No real change occurred to the design of the upper block 11 during the evolution process of the stringed instruments. There is not enough space inside the instrument to enlarge the upper block 11 substantially without disturbing the delicately elaborated balance of the resonance-body 9. In the past, no alternative material or material combination to wood has been available.

The same is true for the lower block 11'. The stronger tensions created by modern strings 1 have not been followed up by changes in its architectural or material concepts. In the past, no alternative material or material-combination has been available.

Lack of Evolutionary Changes to the Tail Piece 5 and Tail Gut 6

The tail piece 5 and the tail gut 6 have been designed in order to withstand the tension caused by the strings 1. The possibility to improve the sound has been secondary. It is well known that a light and strong tail piece 5 transmits the vibrations better to the resonance body 9. The fact that tail piece 5, tail gut 6 and lower peg 7 are all involved in this process has been neglected.

Lack of Evolutionary Changes to the Lower Peg 7

The important role of the lower peg 7 for the transmittance of the vibrations is not visible in the development of bowed stringed instruments The function can also be improved through better adjustment possibilities than the existing lower peg 7.

Summary of Unfavorable Changes Due to the Evolution in the Construction of Fingerboard 3 and Neck 2 for Bowed Musical Instruments:

1) Higher weight of the instrument due to more and heavier material used for the fingerboard's 3 construction.
2) Decreased stiffness of the combination fingerboard/neck compared to higher string tension and its resulting consequences. The now elongated and thinner neck 2, the reduced neck heel 23 and its altered position, make the fingerboard/neck structure more prone to distortion created by the higher tensioned strings.
3) Decreased vibration/resonance-transmitting ability due to one piece hardwood fingerboard 3
4) Decreased rigidity in the area of the neck heel 23. Compared to the historical combination fingerboard/neck, the modern fingerboard/neck structure is weaker towards the heel 23 of the neck 2 and stronger towards the peg box 20. The historical fingerboard/neck was more flexible towards the peg box 20 and stiffer towards the neck heel 23 due to the shape of the historical fingerboard 3. The neck heel 23 was furthermore stiffer because of its bigger dimensions.

Summary of Unfavorable Changes Due to the Evolution in the Construction of Tail Piece 5, Tail Gut 6 and Lower Peg 7 for Bowed Musical Instruments:

The triumvirate of tailpiece 5, tail-gut 6 and lower peg 7 has only been developed in order to withstand a higher and more demanding tension generated by the evolution of the strings. The possibility to improve their vibration/resonance transmitting properties by using improved construction architectures and new materials was neglected.

Aims of the Invention

This patent claims the following inventions to correct the flaws which have occurred during the development of the historical stringed instruments:

First Aim of the Present Invention is to Provide a Fingerboard* with Optimized and Adaptable Vibration/Resonance-Transmitting Qualities in all Three Dimensions:

The vibration/resonance-transmitting qualities of the combination fingerboard/neck and its assembling properties to the instrument's body are essential for the quality, density and long-life of the vibrations/resonance transmitted by fingerboard/neck to the instrument's resonance-body.

As violin family instrument's fingerboards are substantially more massive than those of plucked musical instruments, modifications to bowed instrument's fingerboards are essential to improve their sound in a satisfying way.

A) A Fingerboard 3 with Optimized and Adaptable Vibration/Resonance-Transmitting Qualities in its Longitudinal/Distribution.

Experimentation has shown that the lower part of the fingerboard 3 which is solidly attached to the neck 2 has other vibration/resonance-transmitting qualities than the freestanding part of the fingerboard 3 (violin family instruments). The attached and freestanding parts of the fingerboard 3 need their vibration/resonance-transmitting qualities to be optimized and harmonized in their longitudinal distribution in order to allow an efficient vibration/resonance transmission through the structure fingerboard/neck to the instrument's resonance body. The vibration/resonance-transmitting qualities of the fingerboard 3 also need to be adapted in its longitudinal distribution according to individual string tension and the vibration frequencies which can be produced on each string. Experimentation has shown that the commonly used one piece hardwood fingerboard is far from being optimal in this respect.

B) A Fingerboard 3 with Optimized Vibration/Resonance-Transmitting Qualities in its Lateral Distribution.

Experimentation has shown that depending on resonance frequencies and string tension some materials are better than others to be used for the construction of the fingerboard 3. As the musical-instruments have their string distribution order structured starting from a low vibration frequency string on one side of the fingerboard 3, through gradually rising medium strings regarding their vibration frequency, to the highest vibration frequency string on the opposite side of this fingerboard 3, the required lateral resonance-transmitting qualities of the fingerboard 3 need to be adapted to these frequencies. The string tension of the slowest vibrating string is the lowest; the tension of the fastest vibrating string is the highest. The tension of the medium strings is gradually higher, as their vibration frequencies are raising. The resonance-transmitting qualities of the fingerboard 3 need to be adapted in its lateral distribution according to the individual string tension. Experimentation has shown that the commonly used one piece hardwood fingerboard 3 is far from being optimal in this respect.

C) A Fingerboard 3 with Optimized Vibration/Resonance-Transmitting Qualities in its Altitude Distribution:

Experimentation has shown that the lower part of the fingerboard 3 which is solidly attached to the neck has other vibration/resonance-transmitting qualities than the freestanding part of the fingerboard 3 (violin family instruments). The attached and freestanding parts of the fingerboard 3 need their vibration/resonance-transmitting qualities to be optimized and harmonized in their altitude distribution in order to allow an efficient vibration/resonance transmission through the structure fingerboard/neck to the instrument's resonance body. Experimentation has shown that the commonly used one piece hardwood fingerboard is far from being optimal in this respect.

Experimentation has furthermore shown that depending on resonance frequencies and string tension some materials are better than others to be used for the construction of the fingerboard. As the musical-instruments have their string distribution order structured starting from a low vibration frequency string on one side of the fingerboard 3, through gradually rising medium strings regarding their vibration frequency, to the highest vibration frequency string on the opposite side of this fingerboard 3, the required altitude vibration/resonance-transmitting qualities of the fingerboard 3 need to be adapted to these frequencies. The string tension of the slowest vibrating string is the lowest; the tension of the fastest vibrating string is the highest. The tension of the medium strings is gradually higher, as their vibration frequencies are raising. The vibration/resonance-transmitting qualities of the fingerboard 3 need to be adapted in its altitude distribution according to the individual string tension and the vibration frequencies which can be produced on each string. Experimentation has shown that the commonly used one piece hardwood fingerboard 3 is far from being optimal in this respect.

Second Aim of the Present Invention is to Provide a Fingerboard 3* with Optimized and Adaptable Stiffness/Flexibility in all Three Dimensions.

The stiffness/flexibility of the combination fingerboard/neck and its assembling properties to the instrument's resonance body are essential for the quality, density and long-life of string vibration, and thus for the quality of the produced sound. To optimize the ratio stiffness-flexibility/vibration, the different vibration-frequencies and individual string tension of each string have to be considered.

A) A Fingerboard 3 with Optimized and Adaptable Stiffness/Flexibility in its Longitudinal Distribution.

Experimentation has shown that the lower part of the fingerboard 3 which is solidly attached to the neck has a different stiffness/flexibility than the freestanding part of the fingerboard 3. The attached and the freestanding parts of the fingerboard 3 (violin family) need their stiffness/flexibility to be harmonized in order to allow an optimized resonance transmission through the structure fingerboard/neck to the instruments body, and this in all playing-positions on the fingerboard 3. Furthermore a decreasing stiffness in the structure fingerboard/neck from neck heel to upper saddle will favor the lower frequencies, and this is a step back to what was an intended and common feature to be found on historical instruments of the violin family, from its creation up to the end of the 18th century, now this old knowledge is adapted for today's demand in performing highly complex musical scores, using completely new materials and techniques for this new fingerboard's 3 construction. Increased stiffness of the fingerboard's 3 freestanding (violin family) part will also make playing in higher positions more comfortable, because the fingers will feel the strings closer to this fingerboard 3; the quality of the so called vibrato will be enhanced in these higher positions too. Experimentation has shown that depending on resonance-frequencies and individual string tension, the stiffness of the fingerboard 3 needs to be adapted in its longitudinal distribution, in order to optimize the string vibrations and thus the sound qualities of the instrument. The commonly used one piece hardwood fingerboard 3 is far from being optimal in this respect.

B) A Fingerboard 3 with Optimized and Adaptable Stiffness/Flexibility in its Lateral Distribution.

Experimentation has shown that depending on resonance-frequencies and string tension an adapted stiffness in the lateral sense is required. As the musical instruments have their string distribution order structured starting from a low vibration frequency string on one side of the fingerboard, through gradually rising medium strings regarding their vibration frequency, to the highest vibration frequency string on the opposite side of this fingerboard, the required lateral stiffness/flexibility of the fingerboard needs to be adapted to these specific frequencies. The string tension of the slowest vibrating string is the lowest, the tension of the fastest vibrating string is the highest. The tension of the medium strings is gradually higher, as their vibration frequency is rising. The stiffness/flexibility of the fingerboard needs to be adapted in its lateral distribution according the individual string tension. The commonly used one piece hardwood fingerboard is far from being optimal in this respect.

C) A Fingerboard 3 with Optimized and Adaptable Stiffness/Flexibility in its Altitude/Distribution.

Experimentation has shown that the lower part of the fingerboard 3 which is solidly attached to the neck has a different stiffness/flexibility than the freestanding part of the fingerboard 3. The attached and the freestanding parts of the fingerboard 3 (violin family) need their stiffness/flexibility to be harmonized in their altitude distribution in order to allow an optimized resonance transmission through the structure fingerboard/neck to the instruments resonance body, and this in all playing-positions on the fingerboard. Furthermore a decreasing stiffness in the structure fingerboard/neck from neck heel to upper saddle will favor the lower frequencies, and this is a step back to what was an intended and common feature to be found on historical instruments of the violin family, from its creation up to the end of the 18th century, now this old knowledge is adapted for today's demand in performing highly complex musical scores, using completely new materials and techniques for this new fingerboard's construction. Increased stiffness of the fingerboard's 3 freestanding (violin family) part will also make playing in higher positions more comfortable, because the fingers will feel the strings closer to this fingerboard 3; the quality of the so called vibrato will be enhanced in these higher positions too. Experimentation has shown that depending on resonance-frequencies and individual string tension, the stiffness/flexibility of the fingerboard 3 needs to be adapted in its altitude distribution, in order to optimize the string vibrations and thus the sound qualities of the instrument. The commonly used one piece hardwood fingerboard 3 is far from being optimal in this respect.

Experimentation has furthermore shown that depending on resonance-frequencies and string tension an adapted stiffness in the altitude sense is required. As the musical instruments have their string distribution order structured starting from a low vibration frequency string on one side of the fingerboard, through gradually rising medium strings regarding their vibration frequency, to the highest vibration frequency string on the opposite side of this fingerboard, the required altitude stiffness of the fingerboard needs to be adapted to these specific frequencies. The string tension of the slowest vibrating string is the lowest, the tension of the fastest vibrating string is the highest. The tension of the medium strings is gradually higher, as their vibration frequency is rising. The stiffness/flexibility of the fingerboard needs to be adapted in its altitude distribution according the individual string tensions. The commonly used one piece hardwood fingerboard 3 is far from being optimal in this respect.

Third Aim of the Present Invention is to Provide a Fingerboard* 3 with Reduced Weight, in Order to Reduce the Masses to be Set into Resonance.

The reduced masses to be set into vibration are essential for the quality, density and long-life of string vibration as well as for the vibration of the combination fingerboard/neck, and thus for the quality of the produced sound. This is a step back to what was an intended and common feature on historical instruments of the violin family, from its creation up to the end of the 18th. century; now this old knowledge is adapted for today's demand in performing highly complex musical scores, using completely new materials and techniques for this fingerboard's construction. Experimentation has shown that the commonly used one piece hardwood fingerboard 3 is far from being optimal in this respect.

Fourth Aim of the Present Invention is to Provide a Fingerboard* 3 with Optimized and Adapted Surface Coating.

Experimentation has shown that the surface of hardwood has a good finger-touch feeling, but other materials used for the surface will optimize resonance transmission, weight reduction, stiffness adaption and physical playing facilities, such as better sweat-absorption, temperature feeling etc. The commonly used one piece hardwood fingerboard 3 is far from being optimal in this respect.

The fingerboard 3 construction of many plucked musical instruments differs basically in 4 points compared to bowed musical instrument fingerboards:

1. insertion of frets
2. flat surface
3. the major part of the fingerboard 3 is glued on the neck, and the resonance table overlapping part of it is usually glued on this resonance table.
4. larger in width due to more strings (ex: violin family 4 strings, guitar 6 strings and more)

Fifth Aim of the Present Invention is to Provide a Neck 2 with Optimized and Adaptable Vibration/Resonance-Transmitting Qualities in all Three Dimensions.

The vibration/resonance-transmitting qualities of the combination fingerboard/neck and its assembling properties to the instrument's body are essential for the quality and density of the vibrations/resonance transmitted by fingerboard/neck to the instrument's resonance-body. As plucked musical instruments usually have substantially more massive necks than instruments of the violin family, modifications to the necks of these plucked instruments will be essential to improve their sound in a satisfying way.

A) A Neck 2 with Optimized and Adaptable Vibration/Resonance-Transmitting Qualities in its Longitudinal Distribution.

Experimentation has shown that the neck 2 needs its resonance-transmitting qualities to be harmonized in its longitudinal direction, in order to allow an optimized resonance-transmission through the structure fingerboard/neck to the instrument's resonance body, The vibration/resonance-transmitting qualities of the neck also need to be adapted in its longitudinal distribution according to individual string tension and the vibration frequencies which can be produced on each string. Experimentation has shown that the commonly used hardwood neck 2 is far from being optimal in this respect.

B) A Neck 2 with Optimized Vibration/Resonance-Transmitting Qualities in its Lateral Distribution.

Experimentation has shown that depending on resonance frequencies and string tension some materials are better than others to be used for the construction of the neck 2. As the musical-instruments have their string distribution order structured starting from a low vibration frequency string on one side of the fingerboard 3, through gradually rising medium strings regarding their vibration frequency, to the highest vibration frequency string on the opposite side of this neck 2, the required lateral vibration/resonance-transmitting qualities of the neck 2 need to be adapted to these frequencies. The string tension of the slowest vibrating string is the lowest, the tension of the fastest vibrating string is the highest. The tension of the medium strings is gradually higher, as their vibration frequencies are raising. The resonance-transmitting qualities of the neck 2 need to be adapted in their lateral distribution according to the individual string tension. Experimentation has shown that the commonly hardwood neck 2 is far from being optimal in this respect.

C) A Neck 2 with Optimized Vibration/Resonance-Transmitting Qualities in its Altitude Distribution.

Experimentation has shown that the neck 2 needs it's vibration/resonance-transmitting qualities to be harmonized in its altitude direction, in order to allow an optimized resonance-transmission through the structure fingerboard/neck to the instrument's body, and this in all playing positions. Experimentation has shown that the commonly used hardwood neck 2 is far from being optimal in this respect.

Experimentation has furthermore shown that depending on resonance frequencies and string tension some materials are better than others to be used for the construction of the neck 2. As the musical-instruments have their string distribution order structured starting from a low vibration frequency string on one side of the fingerboard 3, through gradually rising medium strings regarding their vibration frequency, to the highest vibration frequency string on the opposite side of this neck 2, the required altitude vibration/resonance-transmitting qualities of the neck 2 need to be adapted to these frequencies. The string tension of the slowest vibrating string is the lowest, the tension of the fastest vibrating string is the highest. The tension of the medium strings is gradually higher, as their vibration frequencies are raising. The vibration/resonance-transmitting qualities of the neck 2 need to be adapted in their altitude distribution according to individual string tension and the vibration-frequencies which can be produced on each string. Experimentation has shown that the commonly used hardwood neck 2 is far from being optimal in this respect.

Sixth Aim of the Present Invention is to Provide a Neck 2 with Optimized and Adaptable Stiffness/Flexibility in all Three Dimensions.

The stiffness/flexibility of the combination fingerboard/neck and its assembly properties to the instrument's body are essential for the quality, density and long-life of string vibration, and thus for the quality of the produced sound. To optimize the ratio stiffness-flexibility/vibration, the different vibration-frequencies and individual string tension of each string have to be considered.

A) A Neck 2 with Optimized and Adaptable Stiffness/Flexibility in its Longitudinal Distribution.

Experimentation has shown that the longitudinal stiffness/flexibility of the neck 2 is essential for the vibration quality, density and long-life of the strings, and thus for the quality of the produced sound. To optimize the ratio stiffness-flexibility/resonance, individual string-tension and vibration frequencies which can be produced on each string have to be considered. The stiffness/flexibility of the neck 2 needs to be adapted in its longitudinal distribution, in order to optimize these string vibrations. Experimentation has shown that the commonly used hardwood neck 2 is far from being optimal in this respect.

B) A Neck 2 with Optimized and Adaptable Stiffness/Flexibility in its Lateral Distribution.

Experimentation has shown that depending on resonance-frequencies which can be produced on each string and individual string tension, an adapted stiffness in the lateral sense is required. As the musical instruments have their string distribution order structured starting from a low vibration frequency string on one side of the neck 2, through gradually rising medium strings regarding their vibration frequencies, to the highest vibration frequency string on the opposite side of this neck 2, the required lateral stiffness of the neck 2 needs to be adapted to these frequencies. The tension of the slowest vibrating string is the lowest, the tension of the fastest vibrating string is the highest. The tension of the medium strings is gradually higher, as their vibration frequencies are rising. The stiffness of the neck 2 needs to be adapted in its lateral distribution according to the individual string tensions. The commonly used hardwood neck 2 is far from being optimal in this respect.

C) A Neck 2 with Optimized and Adaptable Stiffness/Flexibility in its Altitude/Distribution Experimentation has shown that the altitude stiffness/flexibility of the neck 2 is essential for the vibration quality, density and long-life of the strings, and thus for the quality of the produced resonance. To optimize the ratio stiffness-flexibility/resonance, resonance-frequencies and individual string-tension of each string have to be considered. The stiffness/flexibility of the neck 2 needs to be adapted in its altitude distribution, in order to optimize these string vibrations. Experimentation has shown that the commonly used hardwood neck 2 is far from being optimal in this respect.

Experimentation has furthermore shown that depending on resonance-frequencies and string tension of each string, an adapted stiffness in the altitude sense is required. As the musical instruments have their string distribution order structured starting from a low vibration frequency string on one side of the neck 2, through gradually rising medium strings regarding their vibration frequencies, to the highest vibration frequency string on the opposite side of this neck 2, the required altitude stiffness of the heck needs to be adapted to these frequencies. The tension of the slowest vibrating string is the lowest, the tension of the fastest vibrating string is the highest. The tension of the medium strings is gradually higher, as their vibration frequencies are rising. The altitude stiffness of the neck 2 needs to be adapted in its distribution according to the individual string tensions The commonly used hardwood neck 2 is far from being optimal in this respect.

Seventh Aim of the Present Invention is to Provide a Neck 2 with Reduced Weight, in Order to Reduce the Masses to be Set into Resonance.

The reduced masses to be set into vibration are essential for the quality, density and long-life of string vibration as well as for the vibration of the combination fingerboard/neck, and thus for the quality of the produced sound. Experimentation has shown that the commonly used hardwood neck 2 is far from being optimal in this respect.

As the necks 2 of plucked musical instruments are substantially more massive than those of the violin family instruments, a weight reduction of the plucked instrument's necks is essential in order to obtain a satisfying sound improvement.

Eight Aim of the Present Invention is to Provide a Neck 2 with Optimized and Adapted Surface Coating.

Experimentation has shown that the surface of hardwood has a good finger-touch feeling, but other materials used for the surface will optimize resonance transmission, weight reduction, stiffness adaption and physical playing facilities, such as better sweat-absorption, temperature feeling etc. The commonly used hardwood neck 2 is far from being optimal in this respect.

Ninth Aim of the Present Invention is to Provide a Neck-Heel 23 with Optimized and Adaptable Stiffness/Flexibility and Vibration/Resonance-Transmitting Qualities in all Three Dimensions.

Due to the modern neck assembling with the instrument's body (violin family), the neck-heel 23 is now the most unsuitable part of the vibrating structure fingerboard/neck. In general, it needs special attention regarding its vibration/resonance-transmitting qualities, its stiffness/flexibility adaption and its assembling qualities to the instrument's resonance body (upper block 11).

The neck-heel's 23 vibration/resonance-transmitting properties, its stiffness/flexibility and weight distribution should ideally be conceived for the whole structure fingerboard/neck, in order to transmit their vibrations in the most efficient way to the resonance-body of the instrument.

At the same time it should have an adapted stiffness/flexibility in order to guarantee a strong holding position for the strings at the upper saddle. The commonly used hardwood neck is far from being optimal in this respect.

The neck 2 construction of many plucked musical instruments differs basically in 3 points compared to bowed musical instrument necks:

- it is larger in width due to 6 strings and more
- it is proportionally longer compared to the resonance body of the instrument
- neck 2 and neck-heel 23 are often made in 2 pieces of wood glued together.

Tenth Aim of the Present Invention is to Provide a Tailpiece 5 with Optimized and Adaptable Stiffness/Flexibility and Vibration/Resonance-Transmitting Qualities in all Three Dimensions. (Violin Family)

The tailpieces 5 of the traditional bowed-instruments are made out of the following materials in order to resist to string tension: ebony, and other hardwoods, carbon-fiber, metals like titanium and aluminum, polymers etc.

Similar construction-principles as for the above mentioned fingerboards 3 could be used for the fabrication of efficient working tailpieces 5.

Eleventh Aim of the Present Invention is to Provide a Tailpiece Gut 6 Made by Different Material-Combinations and Construction-Principles in Order to Optimize and Adapt their Vibration/Resonance-Transmitting Qualities (Violin Family)

The tailpiece gut 6 transmits the vibrations of the strings and tailpiece 5 via the lower saddle 13 and lower peg 7 to the instrument's resonance body.

Natural or synthetic fibers hold together with an adapted resin or glue will transmit these vibrations more efficiently than the currently used materials.

Twelfth Aim of the Present Invention is to Provide an Upper 10 and Lower Saddle 13 Made by Different Materials and Construction-Principles in Order to Optimize and Adapt their Vibration/Resonance-Transmitting Qualities The upper saddle 10 has a direct contact to the structure fingerboard/neck. Its part of transmitting the vibrations from the strings to the structure fingerboard/neck is important. In order to optimize the vibration/resonance-transmitting qualities of the upper saddle and to optimize the stiffness/flexibility of the combination fingerboard/neck, the fingerboard/upper saddle can be made in one piece, or one composite structure. The lower saddle 13 (violin family) transmits the vibrations of the tailpiece gut. The commonly used materials, such as hardwood or ivory are far from being optimal in this respect.

Thirteenth Aim of the Present Invention is to Provide an Upper Block 11, Lighter and Reinforced in Strength, Made Out of Different Materials in Order to Optimize and Adapt its Weight, Stiffness/Flexibility and Vibration/Resonance-Transmitting Qualities The upper block 11, traditionally made of wood, must be stronger than the traditional upper block, and its design should help to distribute the torsion and vibrations of the strings (through structure fingerboard/neck) in an efficient way to the body of the instrument. It should also help to give the strings at the upper saddle a strong holding position. The commonly used woods and shapes are far from being optimal in this respect.

Fourteenth Aim of the Present Invention is to Provide a Lower Block 11', Lighter and Reinforced in Strength, Made Out of Different Materials in Order to Optimize and Adapt its Weight, Stiffness and Resonance-Transmitting Qualities The lower block 11', traditionally made of wood, must be stronger than the traditional lower block, and its design should help to distribute the torsion and vibrations of the strings (through tailpiece, tailpiece gut and lower peg in the case of violin family instruments) in an efficient way to the body of the instrument. The commonly used materials and shapes are far from being optimal in this respect.

Fifteenth Aim of the Present Invention is to Provide Bassbar or Soundbar 25, Lighter and Reinforced in Strength, Made Out of Different Materials in Order to Optimize and Adapt its Weight, Stiffness and Vibration/Resonance-Transmitting Qualities The bassbar or soundbar 25, traditionally made of spruce, can have their weight/stiffness/resonance-transmitting ratio increased by the use of the materials and construction principles mentioned below.

Sixteenth Aim of the Present Invention is to Provide a Sound-Post 17 or Sound-Peg, Lighter and Adapted in Strength, Made Out of Different Materials in Order to Optimize and Adapt its Weight, Stiffness and Vibration/Resonance-Transmitting Qualities.

The sound-post 17 or sound-peg, traditionally made of spruce, can have its weight/stiffness/vibration/resonance-transmitting ratio increased by the use the materials and construction principles mentioned below.

Seventeenth Aim of the Present Invention is to Provide a Lower Peg 7 Lighter and Adapted in Strength, Made Out of Different Materials in Order to Optimize and Adapt its Weight, Stiffness and Vibration/Resonance-Transmitting Qualities.

The lower peg 7, traditionally made of hardwood or ivory can have its weight/stiffness/vibration/resonance-transmitting ratio increased by the use the materials and construction principles mentioned below.

A new conceived asymmetrical shape of it can help to adjust the passage of the strings 1 over the bridge 8 in regard of string-angle/weight distribution. This is achieved by turning the asymmetrical lower peg 7 which changes the position of the passage of the tail gut 6 over the lower saddle 13, and by consequence the positioning of the tailpiece 5.

The asymmetrical lower peg 7 can also be used to correct a not precisely positioned lower peg 7 hole in the lower block 11'.

How to Realize the New Fingerboard 3:

The modern standard fingerboard 3, as described in previous parts of this patent application, can be improved in several ways. In order to modify the fingerboard's 3 physical properties, to adapt these properties for the specific vibration frequency registers of musical instruments generally (for example violin family: violin, viola, tenor viola, cello, double-bass), to repair, to modify or diminish defective sound production (like wolf tones, unpleasant sound-colors) individually, to adapt playing-facilities, or satisfy special requests, an adapted architecture- and material-combination out of the following listed archetypes can be realized.

Aim: Stiffness/Flexibility of the Fingerboard 3

In an embodiment of the invention (see FIGS. 10-14, examples for violin family instruments):

A fingerboard 3 in sandwich construction with a core 30 made out of materials in foam- or hollow-structures of synthetic, non organic or organic origin.

Some of them are:

- pvc, polyester, polypropylene, acrylpolyurethane, and other polymers, nylon
- glass, stone and mineral
- all metals including titanium, aluminum and all metal alloys
- animal parts like bone-structures
- plant parts like light wood, hardwoods, pernambuco-wood, agglomerated, sintered, vitrified or fritted woods and other woods with special properties in regard to stiffness/flexibility/weight ratio
- special plant structures as found in fruits etc.
- sintered and/or vitrified and/or fritted polymers
- Sintered AND/OR Vitrified AND/OR Fritted Metal
- Sintered AND/OR Vitrified AND/OR Fritted Glass, stone and Minerals
- honeycomb-structures and other hollow space-forms manufactured or already existing in nature in divers materials of synthetic, metallic, mineral or organic origin.

Figure 10:
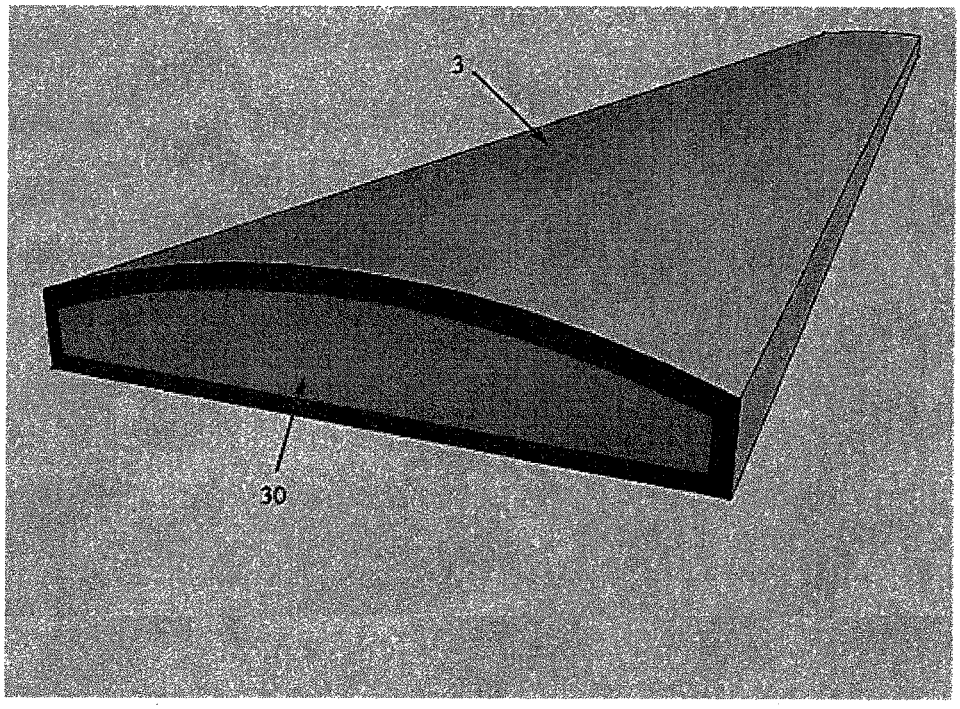
FIG. 10 illustrate a perspective cut view of a fingerboard according to an embodiment.

These structures can also be directly crafted into the fingerboards 3 coating material and become integrated part of the fingerboard 3, see FIG. 10.

The fingerboard 3 can be made of all materials listed here or any suitable combination therefrom.

These core 30/33 materials or structures can be reinforced 32, by the following materials of synthetic, non organic or organic origin (see examples for violin family instruments: FIGS. 11, 12 and 15-16):

- all metals including titanium; aluminum and all metal-alloys
- all organic and non-organic fibers like:
- boron fibers used in common with an adapted resin or glue
- aramid-fibers used in common with an adapted resin or glue
- kevlar-fibers used in common with an adapted resin or glue
- carbon-fibers used in common with an adapted resin or glue
- ceramic-fibers used in common with an adapted resin or glue
- glass-fibers used in common with an adapted resin or glue
- basalt-fibers used in common with an adapted resin or glue
- natural fibers of plant origin used in common with an adapted resin or glue
- parts of plants like leaves, wood, fruits, bamboos veneer, bark etc
- natural fibers of animal origin like silk, spider's web etc
- parts of animal origin like bones, skin, gut, ivory, shell-parts etc
- structures of mineral origin
- Other fibers which can be used for the reinforcement-structures are:

linen, hemp, sisal, jute, flax, bamboo, corn, stalk, esparto, papyrus, reed (reed straw grass), kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pinapple leaf fiber, elephant grass, cotton lint, broom, nettle, henequem, palf, cereal straw, abaca, viscose from different sources and mixtures thereof.

The fibers can be applied in all three dimensional directions.

The resins or glues mentioned above can be of synthetic, polymer or organic origin.

The reinforcement material 32 will mostly be applied on the visible sides of the core 30 (sandwich-construction), partly or entirely. It can also be an integrated part in all three dimensions of the core-structure. It can also be part of the definitive coating surface, partly or entirely.

The stiffness/flexibility-properties of the core- and/or reinforced core can be altered and adapted by perforation or thickness adaption of the materials used for its construction. Special core 30 and/or sandwich-architectures like honeycomb and other hollow structures, as well as special reinforcement architectures can be used in order to achieve the same aim. The form of the core 30 and/or reinforced core 30+32 can differ from the form of the fingerboard 3.

The core 30 and/or reinforced core 30+32 can also already be the complete fingerboard 3. For the production of fingerboards 3, all materials mentioned above can be used alone or in combination with others of them.

The different structures of the fingerboard's 3 construction can include the upper saddle 10.

Aim Resonance-Transmitting Quality of the Fingerboard 3

Figure 13:
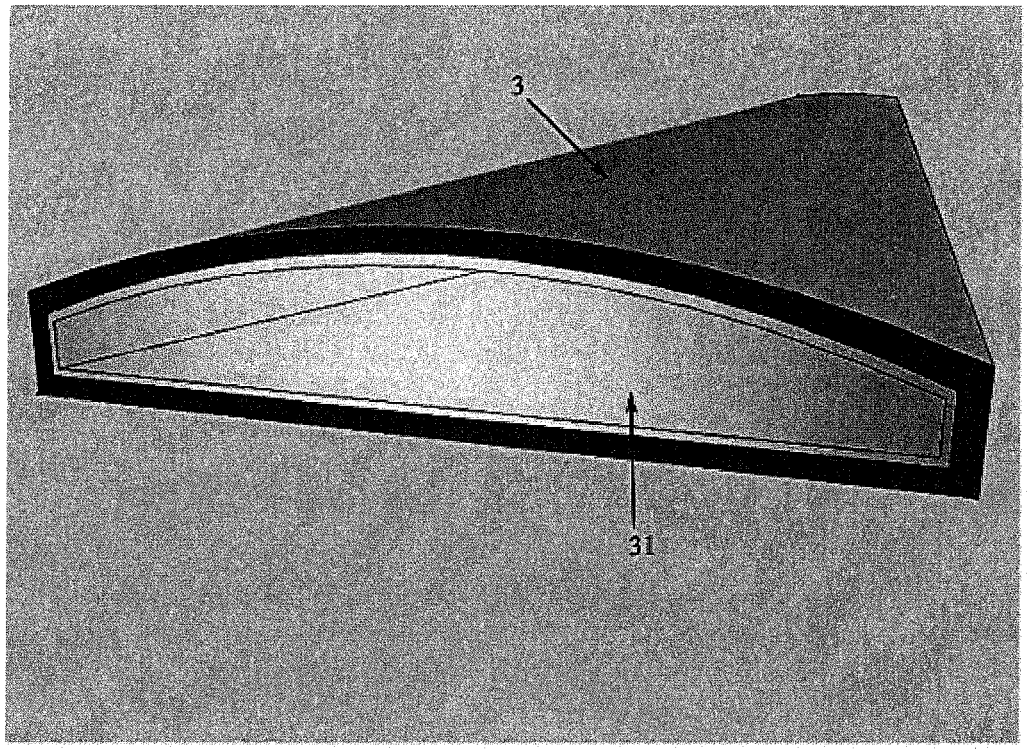
FIG. 13 illustrate a perspective cut view of a fingerboard according to another embodiment.
Figure 14:
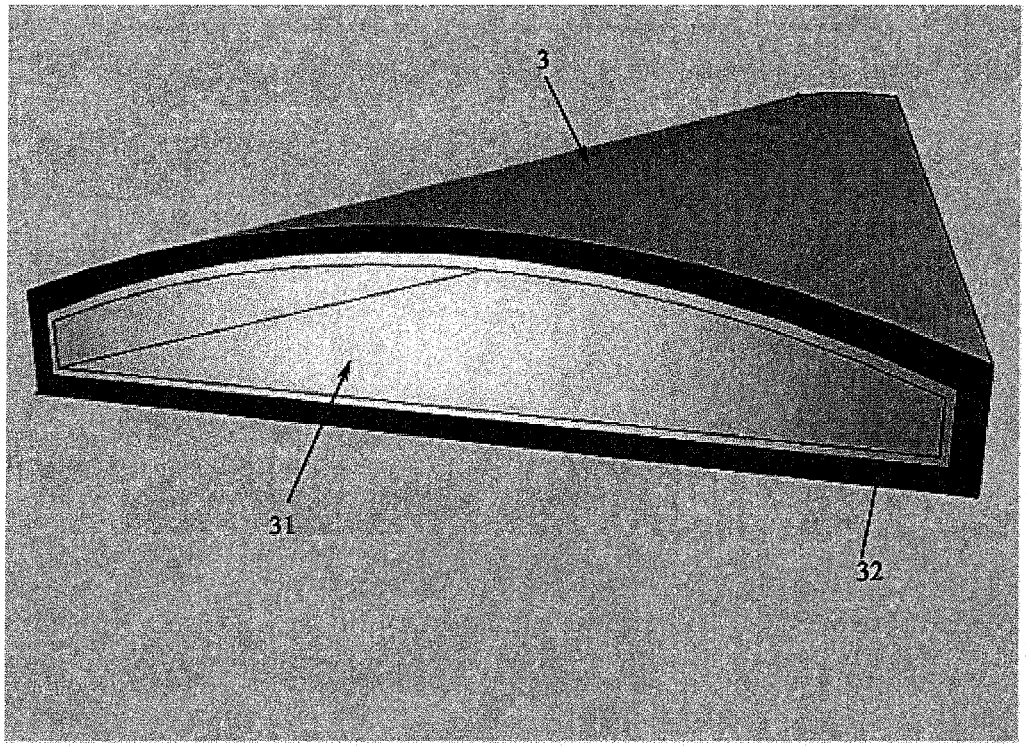
FIG. 14 illustrate a perspective cut view of a fingerboard according to another embodiment.

In another embodiment of the invention:

Fingerboard 3 constructed in hollow profile 31 or using a hollow-profile core 31 made out of materials of synthetic, metallic, mineral, and organic origin, (see FIGS. 13 and 14 as examples for violin family instruments).

Some of them are:

pvc, polyurethane, and other polymers, nylon
glass, stone and mineral ceramic, porcelain
all metals including titanium, aluminum and all metal alloys
animal parts like bone-structures
plant parts like, hardwoods, pernambuco-wood, agglomerated woods and other woods with special properties in regard to stiffness/flexibility/weight ratio
special plant structures as found in fruits etc.
all organic and anorganic fibers like:
aramid-fibers used in common with an adapted resin or glue
kevlar-fibers used in common with an adapted resin or glue
carbon-fibers used in common with an adapted resin or glue
ceramic-fibers used in common with an adapted resin or glue
glass-fibers used in common with an adapted resin or glue
basalt-fibers used in common with an adapted resin or glue
natural fibers of plant origin used in common with an adapted resin or glue
parts of plants like leaves, wood, fruits, bamboos veneer, bark etc
natural fibers of animal origin like silk, spider's web etc
parts of animal origin like bones, skin, spider, larvae, gut, ivory, shell-parts etc
structures of mineral origin
Other fibers which can be used for the hollow profile or hollow profile core are:

linen, hemp, sisal, jute, flax, bamboo, corn, stalk, esparto, papyrus, reed (reed straw grass), kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pinapple leaf fiber, elephant grass, cotton lint, broom, nettle, henequem, palf, cereal straw, abaca, viscose from different sources and mixtures thereof.

The fibers can be applied in all three dimensional directions.

The resins or glues mentioned above can be of natural, synthetic, non-organic and or organic origin.

The resonance-transmitting properties of the hollow profile 31 ore hollow profile core 31 can be altered and adapted by perforation, separation, or thickness adaption of the materials used for its construction.

The form of the hollow-profile core 31 can differ from the form of the fingerboard 3.

The hollow profile can also already be the complete fingerboard 3.

For the construction of fingerboards 3, all materials mentioned above can be used alone or in combination with others of them.

The different structures of the fingerboard's 3 construction can include the upper saddle 10.

Aim Reduced Weight of the Fingerboard 3

In another embodiment of the invention:

Fingerboard 3 constructed by using lightweight materials and construction architectures among those mentioned above.

Aim Adapted Properties of the Fingerboard 3 in all Three Dimensions

Longitudinal, Attitudinal and Lateral Properties

In another embodiment of the invention:

A Fingerboard made in different dependent and/or independent structures in all three dimensions:

in its longitudinal distribution
in its altitude distribution
in its lateral distribution or a combination of all of them using a choice or combination of the above mentioned materials and construction principles for its construction.

Open spaces, or inserts with elastic materials like polymer and/or silicon and/or rubber and/or textiles etc. can be used to avoid undesired sources of vibrations between the independent structures.

The different structures of the fingerboard's construction can include the upper saddle. 10

Aim Surface Coating of the Fingerboard 3

In another embodiment of the invention:

A Fingerboard 3 using one, or a combination of the above mentioned archetypes. It can be veneered by: materials of synthetic, metallic, mineral or organic origin.

Some of them are:

pvc, polyurethane, and other polymers, nylon
glass, stone and mineral ceramic, porcelain
all metals including titanium, aluminum and all metal alloys
animal parts like bone-structures
plant parts like, hardwoods, pernambuco-wood, agglomerated woods and other woods with special properties in regard to stiffness/flexibility/weight ratio
special plant structures as found in fruits etc.
all organic and anorganic fibers like:
boron fibers used in common with an adapted resin or glue
aramid-fibers used in common with an adapted resin or glue
kevlar-fibers used in common with an adapted resin or glue
carbon-fibers used in common with an adapted resin or glue
ceramic-fibers used in common with an adapted resin or glue
glass-fibers used in common with an adapted resin or glue
basalt-fibers used in common with an adapted resin or glue
natural fibers of plant origin used in common with an adapted resin or glue
parts of plants like leaves, wood, fruits, bamboos veneer, bark etc
natural fibers of animal origin like silk, spider's web etc
parts of animal origin like bones, skin, spider, larvae, gut, ivory, shell-parts etc
structures of mineral origin Other fibers which can be used for the surface coating are:

linen, hemp, sisal, jute, flax, bamboo, corn, stalk, esparto, papyrus, reed (reed straw grass), kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pinapple leaf fiber, elephant grass, cotton lint, broom, nettle, henequem, palf, cereal straw, abaca, viscose from different sources and mixtures thereof.

The fibers can be applied in all three dimensional directions.

The resins or glues mentioned above can be of synthetic, polymer or organic origin The fingerboard 3 can be veneered partly or on all visible sides including the part to be glued on the neck 2.

Veneer can be combined with apparent surfaces of cores 30, reinforced cores 30+32 or hollow profiles. 31

The surface coating can consist of one ore more hollowed piece(s) made out of the above mentioned materials, or any kind of assembly of them.

Specially treated material can also be used which are modified in:

color
resistance to wear and sweat,
touch feeling
stiffness/flexibility
resonance-transmitting properties.

These modifications can also concern:

playing facilities,
fingerboard 3 appearance
contact with the neck 2.

For the veneering of fingerboards 3, all materials mentioned above can be used alone or in combination with others of them.

The different structures of the fingerboard's 3 construction can include the upper saddle 10. For plucked musical instrument fingerboards 3 the frets can be part of the core 30/reinforced core 30+32 or hollow-profile 31 and be specially involved in vibration/resonance transmitting as in the distribution of flexibility/stiffness.

Fingerboard-veneer and apparent frets being part of the core 30/reinforced core 30+32 or hollow-profile 31 can intermittent in every constellation The frets can be made out of all materials mentioned above.

The frets can also be part of the coating surface.

Aim Vibration/Resonance-Transmitting and Form/Profile Alterations of the Fingerboard 3

In another embodiment of the invention:

A Fingerboard 3 with inserted damping materials to control or modify its resonance. These materials can be wood, silicon, rubber, modified textiles, special densities of expanded PVC, kevlar, macrolon, nylon etc.

Figure 17:
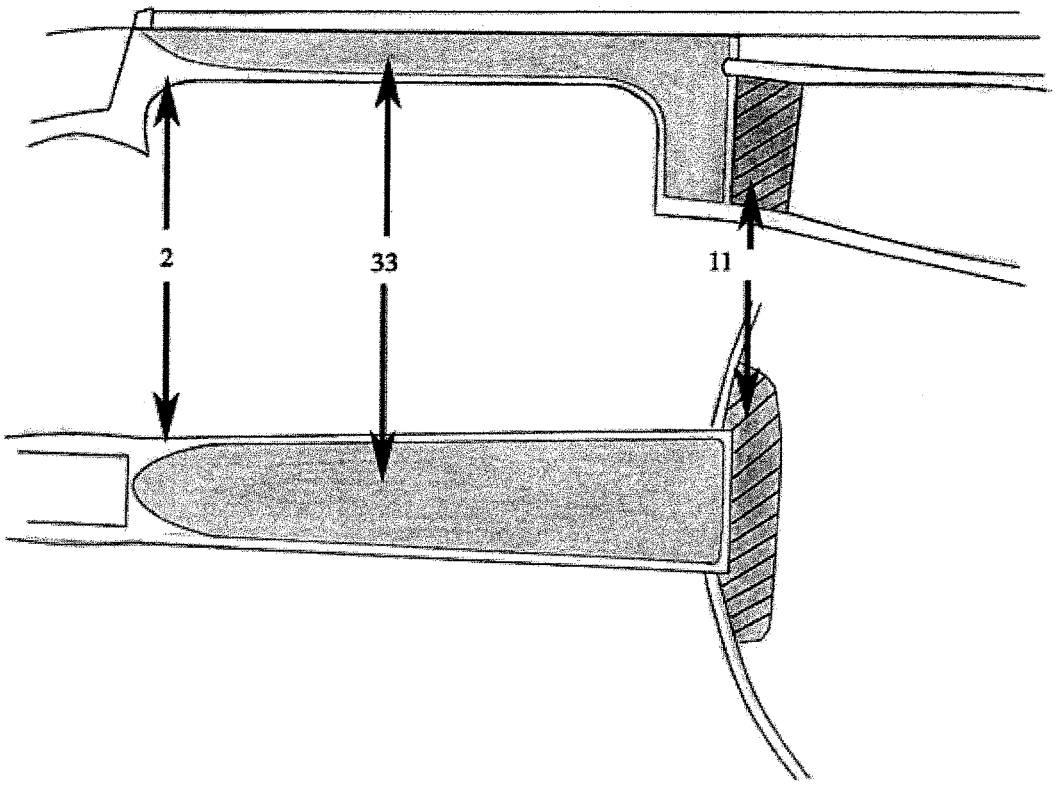
FIG. 17 illustrates a cut view (side and top) of a neck structure in one embodiment.
Figure 18:
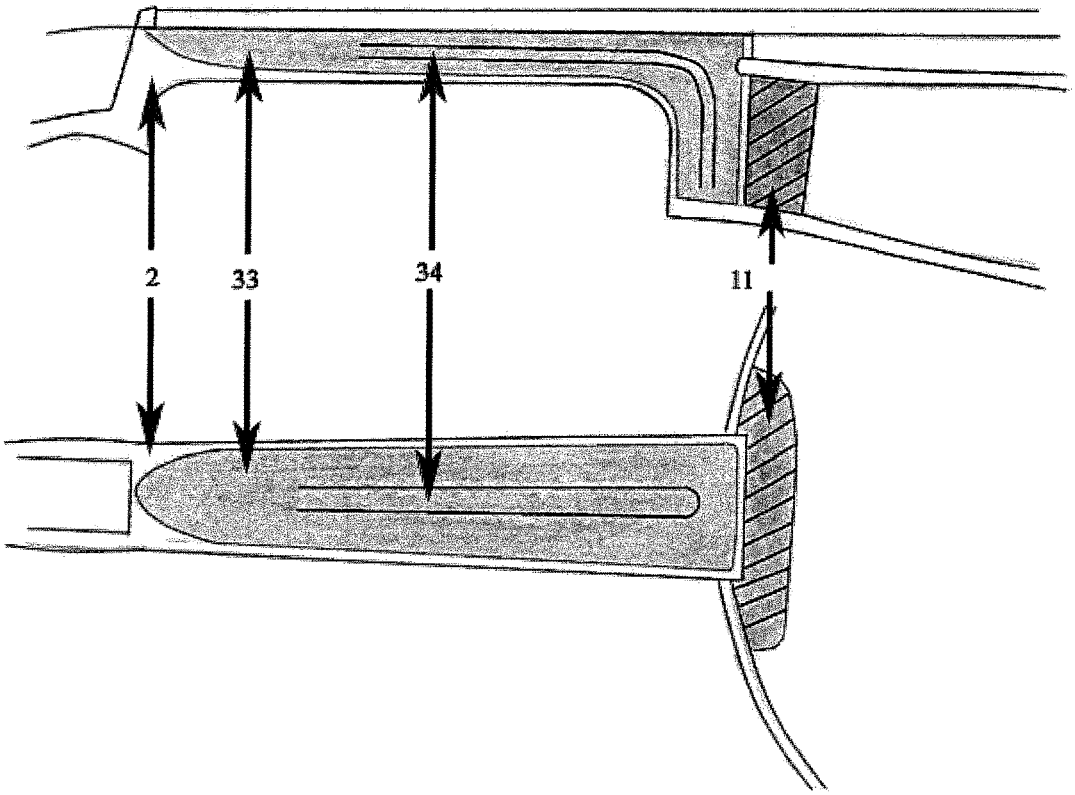
FIG. 18 illustrates a cut view (side and top) of a neck structure in another embodiment.

How to Realize the New Neck (FIGS. 17-18)

The modern standard neck 2, as described in previous parts of this patent, can be improved in several ways. In order to modify the neck's physical properties, to adapt these properties for the specific vibration frequency registers of musical instruments in general (for example violin family instruments: violin, viola, tenor viola, cello and double-bass) to repair, to modify or to diminish defective sound production (like wulftones, unpleasant sound colors) individually, to adapt playing-facilities, or to satisfy special requests, an adapted architecture and material-combination out of the following listed archetypes has to be realized. It is also possible that neck 2 and fingerboard 3 are constructed in one piece, using one or a combination of the lower mentioned sandwich or hollow profile archetypes, with one unique, or different combined coat application(s).

Aim Neck's 2 Stiffness/Flexibility (FIGS. 17-18)

In another embodiment of the Invention:

A neck 2 in sandwich construction with a core 30/33 made out of materials in foam- or hollow-structures of synthetic, metallic, mineral or organic origin.

Some of them are:

pvc, polyurethane, and other polymers, nylon
glass, stone and mineral
all metals including titanium, aluminum and all metal alloys
animal parts like bone-structures
plant parts like light wood, hardwoods, pernambuco-wood agglomerated woods and other woods with special
properties in regard to stiffness/flexibility/weight ratio
special plant structures as found in fruits etc.

honeycomb-structures and other hollow space-forms manufactured or already existing in nature in divers materials of synthetic, metallic, mineral or organic origin.

These structures can also be directly crafted into the coating material of the neck and become integrated part of the neck.

The neck can be made of all materials listed here.

These core 30/33 materials or structures can be reinforced by the following materials of synthetic, metallic, mineral or organic origin to form a reinforced core 30/33.' all metals including titanium; aluminum and all metal-alloys
all organic and non-organic fibers like:
boron fibers used in common with an adapted resin or glue
aramid-fibers used in common with an adapted resin or glue
kevlar-fibers used in common with an adapted resin or glue
carbon-fibers used in common with an adapted resin or glue
ceramic-fibers used in common with an adapted resin or glue
glass-fibers used in common with an adapted resin or glue
basalt-fibers used in common with an adapted resin or glue
natural fibers of plant origin used in common with an adapted resin or glue
parts of plants like leaves, wood, fruits, bamboos veneer, barke etc
natural fibers of animal origin like silk, spider's web etc
parts of animal origin like bones, skin, gut, ivory, shell-parts etc
structures of mineral origin
Other fibers which can be used to reinforce the core 30/33 are: linen, hemp, sisal, jute, flax, bamboo, corn, stalk, esparto, papyrus, reed (reed straw grass), kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pinapple leaf fiber, elephant grass, cotton lint, broom, nettle, henequem, palf, cereal straw, abaca, viscose from different sources and mixtures thereof.

The fibers can be applied in all three dimensional directions.

The resins or glues mentioned above can be of synthetic, polymer or organic origin The reinforcement material will mostly be applied on the visible sides of the core 30/33 (sandwich-construction), partly or entirely.

It can also be an integrated part of the core-structure 34.

It can also be part of the definitive coating surface, partly or entirely.

The stiffness/flexibility-properties of the core 30/33 and/or reinforced core 30/33 can be altered and adapted by perforation or thickness adaption of the materials used for its construction.

Special core and/or sandwich-architectures like honeycomb and other hollow structures, as well as special reinforcement architectures can be used in order to achieve the same aim. The form of the core 30/33 and/or reinforced core 30/33 can differ from the form of the neck 2.

The core 30/33 and/or reinforced core 30/33 can also already be the complete neck 2.

For the production of necks 2, all materials mentioned above can be used alone or in combination with others of them.

The different structures of the neck's 2 construction can include the fingerboard 3, upper saddle 10, pegbox 20, scroll 22 (violin family) upper block 11.

Aim Resonance Transmitting of the Neck 2

In another embodiment of the invention:

The neck 2 constructed in hollow profile or using a hollow-profile core (similar to fingerboard examples: FIGS. 13 and 14) made out of materials of synthetic, metallic, mineral, and organic origin.

Some of them are pvc, polyurethane, and other polymers, nylon glass, stone and mineral ceramic, porcelain all metals including titanium, aluminum and all metal alloys animal parts like bone-structures plant parts like, hardwoods, pernambuco-wood, agglomerated woods and other woods with special properties in regard to stiffness/flexibility/weight ratio special plant structures as found in fruits etc.

all organic and anorganic fibers like:

boron fibers used in common with an adapted resin or glue aramid fibers used in common with an adapted resin or glue kevlar-fibers used in common with an adapted resin or glue carbon-fibers used in common with an adapted resin or glue ceramic-fibers used in common with an adapted resin or glue glass-fibers used in common with an adapted resin or glue basalt-fibers used in common with an adapted resin or glue natural fibers of plant origin used in common with an adapted resin or glue parts of plants like leaves, wood, fruits, bamboos veneer, barke etc natural fibers of animal origin like silk, spider's web etc parts of animal origin like bones, skin, gut, ivory, shell-parts etc structures of mineral origin Other fibers which can be used for the neck's 2 hollow profile are: linen, hemp, sisal, jute, flax, bamboo, corn, stalk, esparto, papyrus, reed (reed straw grass), kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pinapple leaf fiber, elephant grass, cotton lint, broom, nettle, henequem, palf, cereal straw, abaca, viscose from different sources and mixtures thereof.

The fibers can be applied in all three dimensional directions.

The resins or glues mentioned above can be of synthetic, polymer or organic origin The resonance-transmitting properties of the core can be altered and adapted by perforation, separation, or thickness adaption of the materials used for its construction.

The form of the hollow-profile core can differ from the form of the neck 2. The hollow profile can also already be the complete neck 2.

For the construction of necks 2, all materials mentioned above can be used alone or in combination with others of them.

The different structures of the neck's 2 construction can include the fingerboard 3, the upper saddle 10, the peg box 20 and the scroll 22 (violin family) upper block 11

Aim Neck's Weight

In another embodiment of the invention:

A neck 2 constructed by using lightweight materials and construction architectures among those mentioned above.

Aim Adapted Properties of the Neck 2 in all Three Dimensions

Longitudinal, Attitudinal and Lateral Properties

In another embodiment of the invention:

A neck 2 made in different dependent and/or independent structures in all three dimensions:

in its longitude direction in its attitudinal direction in its lateral direction or a combination of both of them using a choice or combination of the above mentioned materials and construction principles for its construction.

Open spaces, or inserts with elastic materials like polymer, and/or silicon and/or rubber and/or textiles etc. can be used to avoid unwilling sources of vibrations between the independent structures.

The different structures of the neck's 2 construction can include the fingerboard 3, the upper saddle 10, the peg box 20 the scroll 22 and the upper block 11.

Aim Surface Coating of the Neck 2

In another embodiment of the invention:

A neck 2 using one, or a combination of the above mentioned archetypes. It can be veneered by: materials of natural, synthetic, metallic, mineral or organic origin.

Some of them are for example:

pvc, polyurethane, and other polymers, nylon glass, stone and mineral, ceramic porcelain all metals including titanium, aluminum and all metal alloys animal parts like bone-structures plant parts like light wood, hardwoods, pernambuco-wood, agglomerated woods and other woods with special properties in regard to stiffness/flexibility/weight/wear ratio special plant structures as found in fruits etc.

all organic and anorganic fibers like:

boron fibers used in common with an adapted resin or glue aramid-fibers used in common with an adapted resin or glue kevlar-fibers used in common with an adapted resin or glue carbon-fibers used in common with an adapted resin or glue ceramic-fibers used in common with an adapted resin or glue glass-fibers used in common with an adapted resin or glue basalt-fibers used in common with an adapted resin or glue natural fibers of plant origin used in common with an adapted resin or glue parts of plants like leaves, wood, fruits, bamboos veneer, barke etc
natural fibers of animal origin like silk, spider's web etc
parts of animal origin like bones, skin, gut, ivory, shell-parts etc
structures of mineral origin
Other fibers which can be used for the neck's 2 surface coating are: linen, hemp, sisal, jute, flax, bamboo, corn, stalk, esparto, papyrus, reed (reed straw grass), kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pinapple leaf fiber, elephant grass, cotton lint, broom, nettle, henequem, palf, cereal straw, abaca, viscose from different sources and mixtures thereof.

The fibers can be applied in all three dimensional directions.

The resins or glues mentioned above can be of synthetic, polymer or organic origin The neck 2 can be veneered partly or on all visible sides including the part to be glued to the fingerboard 3.

Veneer can be combined with apparent surfaces of cores, reinforced cores or hollow profiles.

Neck 2/Neck Heel 23

The core 30/33/reinforced core 30/33 or hollow profile can already have the definitive form and surface of the peg box 20 scroll*22, neck 2, neck heel 23, upper block 11, upper saddle 10 and fingerboard 3, or a selection of some of these. It can be made out of one piece of the above mentioned materials, or a composite of them.

This core 30/33/reinforced core 30/33 or hollow profile can also have a close form to the definitive one which includes the peg box 20/scroll*22, neck 2, neck heel 23, upper block 11, upper saddle 10 and fingerboard 3, or a selection of some of these.

Agglomerated, sintered, vitrified or fritted wood or ceramic coating can be used as veneer in this case among the other materials mentioned above.

This core 30/33 reinforced core 30/33 or hollow profile can also have a different form to the definitive one which includes the peg box 20, scroll*22, neck 2, neck heel 23, upper block 11, upper saddle 10 and fingerboard 3, or a selection of some of these The surface coating can consist of one or more hollowed piece(s) made out of the above mentioned materials, or a different assembly of them.

These hollowed piece(s) can already include peg box 20 scroll*22, neck 2, neck heel 23, upper block 11, upper saddle 10 and fingerboard 3, or a selection of some of these.

If the neck coating is achieved by wood-veneer, one solution is that only the cylindrical part of the neck 2 will be veneered with a thin sheet of wood, and the peg box 20 scroll*22 as well as the neck heel 23 will be grafted with adjusted pieces manufactured out of full wood and glued to the core 30/33/reinforced core 30/33 or hollow profile.

In all cases the peg box 20 scroll (only on bowed musical instruments) 22 can be hollowed too, in order to reduce its weight, for sound or playing-facility reasons.

In order to veneer the core 30/33/reinforced core 30/33 or hollow profile, specially treated woods can be used which are modified in color
resistance to wear and sweat,
touch feeling
stiffness/flexibility
resonance-transmitting properties.

These modifications can also concern:

playing facilities,
neck appearance
contact with the fingerboard

For the veneering of necks 2, all materials mentioned above can be used alone or in combination with others of them.

The different structures of the neck's 2 construction can include the upper block 11, the fingerboard 3, the upper saddle 10, the peg box 20, the neck heel 23, the scroll 22 (violin family instruments), and the upper block 11 or a selection of some of these.

For violin family instruments, the neck heel 23 is traditionally part of the neck 2. It can be exceptionally separated from the neck 2 for production reasons.

How to Realise the New Neck Heel 23

Aim Neck Heel

In another embodiment of the invention:

A Neck heel 23 with specially adapted resonance-transmitting qualities, and specially adapted stiffness/flexibility in all three dimensions, depending on the string-tension and resonance register (violin, viola, cello, double-bass)) of the instrument, using the above mentioned materials and assembly-variations; preferably made in one piece with the core/reinforced core or hollow-profile of the neck 2.

How to Realise the New Tailpiece 5

Aim Tailpiece

In another embodiment of the invention:

A Tailpiece in sandwich or hollow profile construction with a core/reinforced core or hollow profile made out of one or a combination of the above mentioned materials.

The construction principles are the same as for the above described fingerboard 3, including the aims for three dimensional resonance transmitting, three dimensional stiffness/flexibility, as well as resonance transmitting alterations and surface coating.

Specific alterations and reinforcements can be made in order to compensate perforations made to hold the strings 1 and tailpiece gut 6.

These perforations can also be avoided by the creation of specific holding structures for these strings 1 and the tailpiece gut 6.

These holding structures can be placed in specific places of the tailpiece 5, in order to become part of the resonance transmitting alteration aim.

How to Realise the Tailpiece Gut 6

Aim Tailpiece Gut

In another embodiment of the invention:

A tailpiece gut 6 solidly connected with the tailpiece 5, stiff and made out of:

all metals including titanium, aluminum and all metal alloys
all organic and anorganic fibers like:
boron fibers used in common with an adapted resin or glue
aramid-fibers used in common with an adapted resin or glue
kevlar-fibers used in common with an adapted resin or glue
carbon-fibers used in common with an adapted resin or glue
ceramic-fibers used in common with an adapted resin or glue
glass-fibers used in common with an adapted resin or glue
basalt-fibers used in common with an adapted resin or glue
natural fibers of plant origin used in common with an adapted resin or glue natural fibers of animal origin like silk, spider's web etc animal gut used in common with an adapted resin or glue all kinds of filaments The fibers can be used in all three dimensional directions The resins or glues mentioned above can be of synthetic, polymer or organic origin How to Realise the New Upper Saddle 10

Aim Upper 10 and Lower 13 Saddle

In another embodiment of the invention:

An upper 10 and lower 13 saddle in sandwich or hollow profile construction with a core/reinforced core or hollow profile made out of one or a combination of the above mentioned materials and construction principles.

The upper saddle 10 can be made in one part, or divided in 2, 3, 4 and more independent parts, spaced by hollow aeries, or inserts of elastic materials as mentioned above.

The upper saddle 10 can be an integrated part of the fingerboard 3 and/or integrated part of the veneer.

Fussnote zu veener 1-20 mm

How to Realise the New Upper Block 11 (FIGS. 1, 17-18)

Aim Upper Block

In another embodiment of the invention:

An upper block made in sandwich-construction or hollow profile as mentioned above (see fingerboard 3), with adapted stiffness, weight and resonance-transmitting modifications. In order to transmit more efficiently the vibrations or to spread more softly the torsion transmitted by the structure neck/fingerboard 2/3 to table 19, back 24 and rib structure 15 of the resonance-body 9, the upper block's 11 shape can be altered, for ex in V or W shape looked from the front (table 19) and/or in C. L shape looked from the side (ribs 15). These shapes can be asymmetric and of various forms in order to be specially adapted for each individual instrument.

How to Realise the New Lower Block 11'

Aim Lower Block

In another embodiment of the invention:

A lower block 11' made in sandwich-construction or hollow profile as mentioned above (see fingerboard 3), with adapted stiffness, weight and resonance-transmitting modifications. In order to transmit more efficiently the vibrations and/or to spread more softly the torsion transmitted by the lower peg 7 (bowed string instruments) to table 19, back 24 and rib structure 15 of the resonance-body 9, the lower block's 11' shape can be altered, for ex in V or W shape looked from the front (table 19) and/or in C, L shape looked from the side (ribs 15). These shapes can be asymmetric and of various forms in order to be specially adapted for each individual instrument.

A special reinforced hole to hold the lower peg 7 can in some cases be required.

How to Realize the Bassbar, Soundbar 25 (See FIG. 1(*a*))

Aim Bassbar, Soundbars

In another embodiment of the invention:

A Bassbar or soundbars made in sandwich construction or hollow-profile as mentioned above (see fingerboard 3), with adapted stiffness, weight and resonance-transmitting modifications in all three dimensions in order to transmit more efficiently the vibrations and/or spread more efficiently the torsion due to string tension transmitted via bridge 8, table 19, upper and lower block 11.

The bass or soundbars can also be reinforced by the above mentioned synthetic or natural fibers used in common with an adapted resin or glue.

The commonly used woods for their construction or especially light woods can be cut in two or more parts, and glued together again but with inserted reinforcement material parts.

The reinforcement material will mostly be applied on the visible sides of the core (sandwich-construction), partly or entirely. It can also be an integrated part in all three dimensional of the bass or sound bar-structure. It can also be part of the definitive coating surface, partly or entirely.

How to Realize the Soundpost, Soundpegs 17

Aim Sound Post or Sound-Pegs

In another embodiment of the invention:

A Sound post or sound-pegs 16 made in sandwich construction and/or hollow-profile and/or simply of a choice of the materials mentioned above (see fingerboard 3), with adapted stiffness, weight and resonance-transmitting modifications.

How to Realize the Lower Peg 7

Aim Lower Peg:

In another embodiment of the invention:

A lower peg 7 made out of light materials or in sandwich or hollow profile construction with a core/reinforced core or hollow profile made out of one or a combination of the above mentioned materials and construction principles.

A new conceived asymmetrical shape of it can be achieved by manufacturing the tail-gut 6 holding part within a different axle than the conical or cylindrical part to be inserted into the lower block 11'.

In order to give the necessary grip of this asymmetrical lower peg 7 in the hole of the lower block 11', a cylindrical or conical male (lower peg 7) and female part (peg hole in lower block 11) with specific form can be used, as well as special friction materials.

On cellos and double-bass the lower peg 7 holds the tail-spike.

To summarize by reference to the figures of the application:

The FIGS. 10-18 are the representation of basic archetype or exemplary construction-principles which are to be construed in a non-limiting manner. The fingerboard 3/neck 2 structure can be realized with different core/reinforced core and/or hollow profile archetypes:

- the cores 30/33/reinforced cores 30/33' and/or hollow profiles 31 may be of various forms
- they can be divided into different separated compartments in all three dimensions
- they can be asymmetric regarding their form, density and material-application
- they can be combined with other hollow-profile 31 or core 30/33/reinforced core 30/33 structures.
- the core 30/33/reinforced core 30/33 structures or hollow-profiles 31 can be laminated (see FIGS. 11 and 12) on all sides, partly, or not laminated at all
- the lamination can also be part of the reinforcement-structure
- this lamination can be made of different materials as listed above.
- lamination can be made by using combinations of these different materials in order to produce one single composite piece including the peg box 20/scroll 22, neck 2, neck heel 23, upper block 11, upper saddle 10 and fingerboard 3, or a selection of some of these
- the peg box 20/scroll 22, neck 2, neck heel 23, upper block 11, upper saddle 10 and fingerboard 3, or a selection of some of these can also be made in one, using one or more piece(s) of core/reinforced core
- one or more hollow-profile 31(s) or a combination of both (core 30/33/reinforced core 30/33).
- one or more lamination-materials and coats FIG. 10 shows a Fingerboard 3 in sandwich construction with a core 30 made out of one or more of the above mentioned material(s), veneered on four sides with one or more of the above mentioned material(s)

Figure 11:
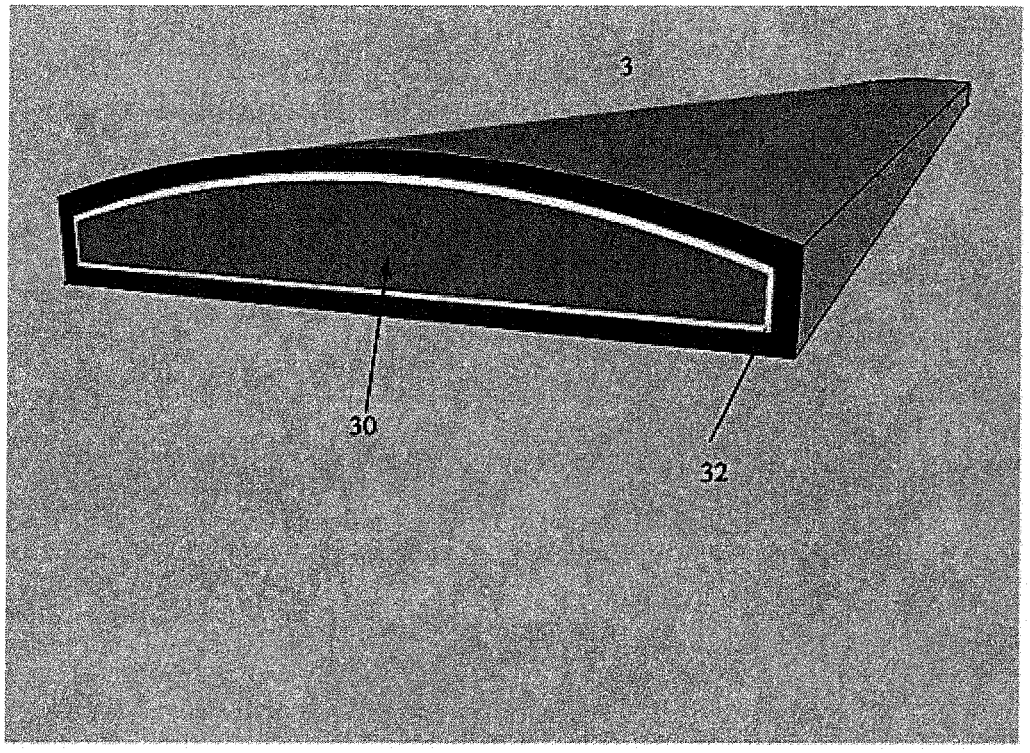
FIG. 11 illustrate a perspective cut view of a fingerboard according to another embodiment.

FIG. 11 shows a Fingerboard 3 in sandwich construction with a core 30 made out of one or more of the above mentioned material(s), and reinforced with one or more of the above mentioned material(s) on four sides (32); veneered on four sides. with one or more of the above mentioned material(s).

Figure 12:
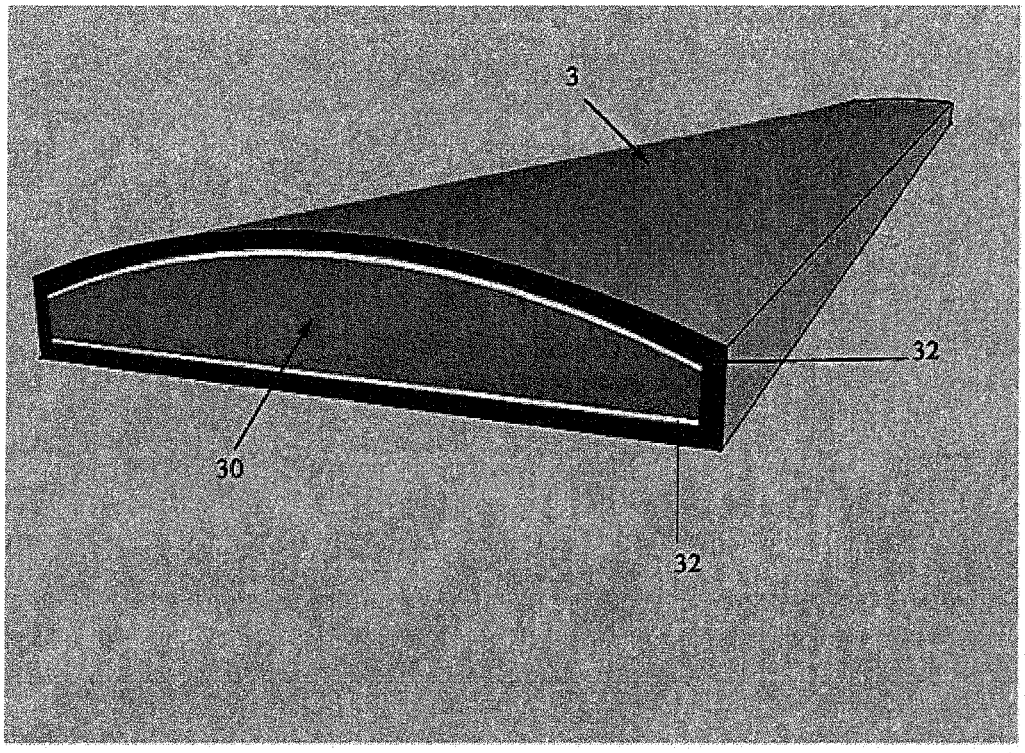
FIG. 12 illustrate a perspective cut view of a fingerboard according to another embodiment.

FIG. 12 shows a Fingerboard 3 in sandwich construction with a core 30 made out of one or more of the above mentioned material(s), and reinforced with one or more of the above mentioned material(s) on two sides (top and bottom 32); veneered on four sides with one or more of the above mentioned material(s).

FIG. 13 shows a Fingerboard 3 with a hollow profile core 31 made out of one or more of the above mentioned material(s) on four sides; veneered on four sides with one or more of the above mentioned material(s).

FIG. 14 shows a Fingerboard 3 with a core/reinforced core as hollow profile core 31 made out of one or more of the above mentioned reinforcement material(s) 32. as a two or multi-parted design (top and bottom and/or left and right, and/or peak and base or asymmetric designs), veneered on four sides with one or more of the above mentioned material(s).

As described above, the construction principles of the fingerboard 3 may be applied to other earlier mentioned parts, such as neck 2, tailpiece 5, etc.

Figure 15:
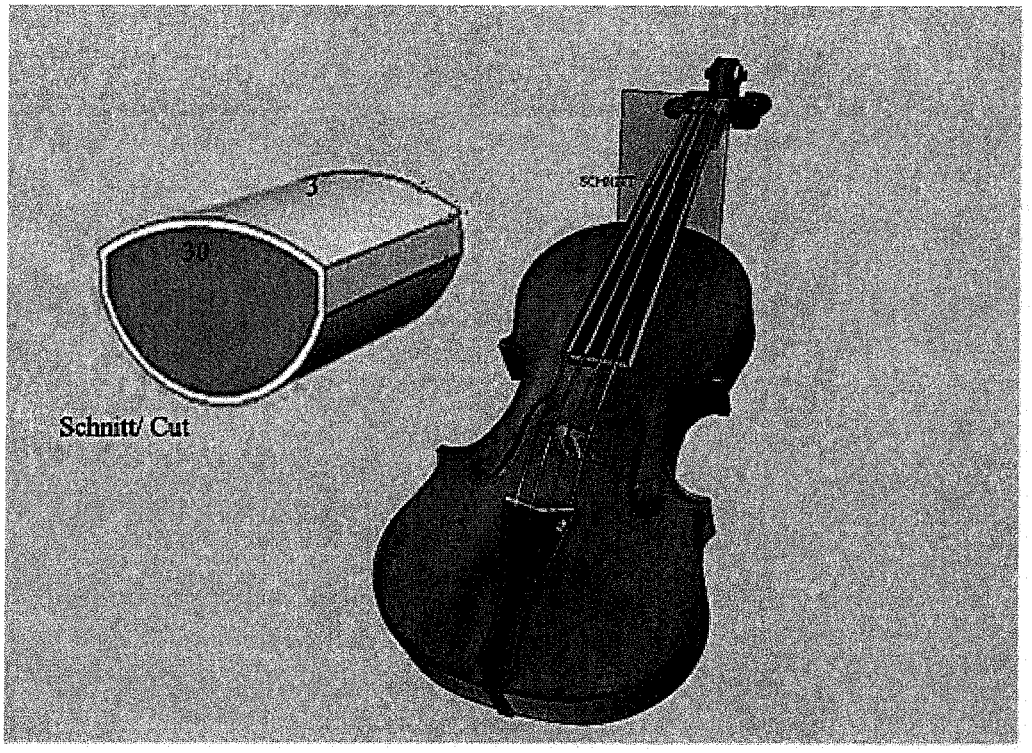
FIG. 15 illustrate a cut view of a fingerboard-neck structure.

FIG. 15 shows a lateral view of a fingerboard 3/neck 2 structure in sandwich construction with a single core 30 made out of one or more of the above mentioned material(s) and reinforced with one or more of the above mentioned material(s), laminated with one or more of the above mentioned material(s) on all visible sides.

Figure 16:
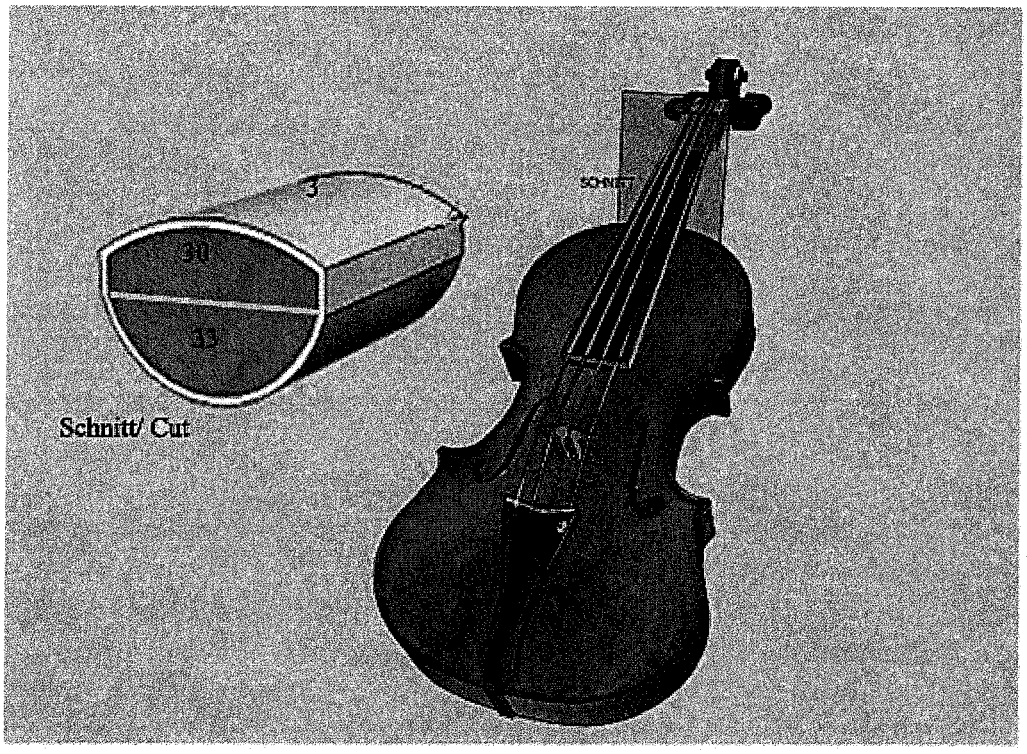
FIG. 16 illustrates a cut view of another fingerboard-neck structure.

FIG. 16 shows a lateral view of a fingerboard 3/neck 2 structure in a two parted sandwich construction with cores 30/33 made out of one or more of the above mentioned materials and reinforced with one or more of the above mentioned material(s), laminated with one or more of the above mentioned material(s) on all visible sides.

FIG. 17 shows a cut through neck 2 structure in a sandwich construction with core 33 made out one or more of the above mentioned material(s) and reinforced with one or more of the above mentioned material(s), laminated with one or more of the above mentioned material (s) on all visible sides.

FIG. 18 shows a cut through neck 2 structure in a sandwich construction with core 33 made out one or more of the above mentioned material(s) and reinforced with one or more of the above mentioned material(s) 34, laminated with one or more of the above mentioned material(s) on all visible sides.

Thin black line 34: reinforcement of the heel of the neck

Other reinforcement fibers that may be used in the present invention include

Polyamid
Meta-amid,
Para-armid
Ortho-armid
Nylon
Reinforced nylon
Polyamid
Reinforced Polyamid
Polyurethan
Polyester
Poly-paraphenylene-terephtalamide (Kevlar)
Any suitable combination of the preceding fibers The reinforcement may also comprise:

Metal thread
Metal wire
Spun metal fibres
Braided, twisted, or spun fibres or filaments The examples given above are only for illustrative purposes and should not be construed in a limiting manner. Other equivalent means and materials may be envisaged within the scope and spirit of the present invention. Also, the different embodiments described above may be combined together in the same instrument as desired.

The invention claimed is:

1. A fingerboard for a violin, wherein said fingerboard is made in a sandwich construction with a fully enclosed core material and wherein the material enclosing the core material has a bottom surface for at least partial attachment to an upper surface of the neck of the violin.

2. The fingerboard as defined in claim 1, wherein said core material is made of foam or hollow-structures of synthetic, non-organic, or organic origin.

3. The fingerboard as defined in claim 1, wherein said core material is made from at least one of polyvinyl chloride, polyester, polypropylene, acrylpolyurethane, polymer, nylon, glass, stone, mineral, metal, metal alloy, titanium, aluminum, animal part, bone, bone-structures, plant part, light wood, hardwood, pernambuco-wood, agglomerated wood, sintered wood, vitrified wood, fitted wood, wood having specific stiffness/flexibility/weight ratio properties, special plant structures, sintered and/or vitrified and/or fritted polymers, sintered and/or vitrified and/or fritted metal, sintered and/or vitrified and/or fritted glass, sintered and/or vitrified and/or fritted stone, sintered and/or vitrified and/or fritted minerals, honeycomb-structures, and hollow space-forms made of synthetic, metallic, mineral or organic materials.

4. The fingerboard as defined in claim 1, wherein said core material is reinforced by a reinforcement material.

5. The fingerboard as defined in claim 4 wherein the reinforcement material has a shape of a metal thread, a metal wire, spun metal fibers, or braided, twisted, or spun fibers or filaments.

6. The fingerboard as defined in claim 4, wherein said organic and non-organic fibers include at least one of boron fibers, aramid fibers, poly-araphenylene-terephthalamide fibers, carbon fibers, ceramic fibers, glass fibers, basalt fibers, natural and synthetic fibers of plant origin, parts of plants, natural and synthetic fibers of animal origin, parts of animal origin, structures of mineral origin, linen, hemp, sisal, jute, flax, bamboo, corn, stalk, esparto, papyrus, reed, reed straw grass, kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pineapple leaf fiber, elephant grass, cotton lint, broom, nettle, henequem, palf, cereal straw, abaca, viscose from different sources and mixtures thereof.

7. The fingerboard as defined in claim 1, wherein the fingerboard comprises a surface coating made of a coating material.

8. The fingerboard as defined in claim 1, wherein the stringed musical instrument is a violin-family instrument.

9. The fingerboard as defined in claim 1, wherein the stringed musical instrument is a guitar-family instrument.

10. The fingerboard as defined in claim 1, further comprising an upper saddle disposed at an end of the fingerboard.

11. A stringed musical instrument comprising:

a resonance body having a resonance table, a back surface spaced apart from the resonance table, and a sidewall connecting the resonance table with the back surface;

a neck attached to the sidewall and extending from the resonance body; and a fingerboard made in a sandwich construction with a core material or with a hollow profile, wherein the fingerboard is attached to the neck and overlapping at least a portion of the resonance table, wherein a material enclosing the core material or enclosing the hollow space of the hollow profile has a bottom surface at least partially attached to an upper surface of the neck.

12. The stringed musical instrument as defined in claim 11, wherein said instrument is a violin-family instrument.

13. The stringed musical instrument as defined in claim 11, wherein said instrument in a guitar-family instrument.

14. The fingerboard of claim 4, wherein said reinforcement material is made from at least one of metal, titanium, aluminum, metal-alloy, natural fibers, synthetic fibers, organic fibers, non-organic fibers, fibers used with an adapted resin or glue of organic or non-organic origin, polyamid, reinforced polyamide, meta-amid, para-amid, ortho-amid, synthetic polymer, reinforced synthetic polymer, polyurethane, polyester, poly-paraphenylene-terephthalamide.

15. A fingerboard for a stringed musical instrument, wherein said fingerboard comprises an enclosed hollow profile, wherein a material enclosing the hollow space of the hollow profile has a bottom surface for at least partial attachment to an upper surface of a neck of the music instrument.

16. A fingerboard for a stringed musical instrument, comprising a fingerboard and a core material positioned in a hollow profile in the fingerboard, wherein the hollow profile has a bottom surface for at least partial attachment to an upper surface of a neck of the music instrument.

17. The fingerboard as defined in claim 16, wherein said core material comprises materials of synthetic, metallic, mineral, or organic origin.

18. The fingerboard as defined in claim 17, wherein said core material comprises at least one of polyvinyl chloride, polyurethane, polymer, glass, stone, mineral, ceramic, porcelain, metal, metal alloy, titanium, aluminum, animal part, bone-structures, plant part, hardwood, pernambuco-wood, agglomerated wood, wood having specific stiffness/flexibility/weight ratio properties, special plant structures, natural fibers, synthetic fibers, organic fibers, and non-organic fibers.

19. The fingerboard as defined in claim 18, wherein said organic and non-organic fibers include at least one of boron fibers, aramid fibers, poly-paraphenylene-terephthalamide fibers, carbon fibers, ceramic fibers, glass fibers, basalt fibers, natural and synthetic fibers of plant origin, parts of plants, natural and synthetic fibers of animal origin, parts of animal origin, structures of mineral origin, linen, hemp, sisal, jute, flax, bamboo, corn, stalk, esparto, papyrus, reed, reed straw grass, kenaf, ramine, rosella, cane sugar fiber, areca fiber, rice husk, wheat, batley, oats, rye, oil palm empty fruit bunch, coir, water hyacinth, pennywort, kapok, paper, mulberry, raphia, banana fiber, pineapple leaf fiber, elephant grass, cotton lint, broom, nettle, henequem, palf, cereal straw, abaca, viscose from different sources and mixtures thereof.

20. The fingerboard of claim 16, wherein the hollow core profile comprises a reinforcement material.

21. The fingerboard of claim 20, wherein the reinforcement material is made from at least one of metal, titanium, aluminum, metal-alloy, natural fibers, synthetic fibers, organic fibers, non-organic fibers, fibers used with an adapted resin or glue of organic or non-organic origin, polyamid, reinforced polyamide, meta-amid, para-amid, ortho-amid, synthetic polymer, reinforced synthetic polymer, polyurethane, polyester, poly-paraphenylene-terephthalamide.

22. The fingerboard as defined in claims 15 and 16, wherein the fingerboard comprises a surface coating made of a coating material.

23. The fingerboard as defined in claims 15 and 16, wherein the stringed musical instrument is a violin-family instrument.

24. The fingerboard as defined in claims 15 and 16, wherein the stringed musical instrument is a guitar-family instrument.

25. The fingerboard as defined in claims 15 and 16, further comprising an upper saddle disposed at an end of said fingerboard.

* * * * *